US006452082B1

(12) United States Patent
Suzuki et al.

(10) Patent No.: US 6,452,082 B1
(45) Date of Patent: Sep. 17, 2002

(54) MUSICAL TONE-GENERATING METHOD

(75) Inventors: Hideo Suzuki, Hamamatsu (JP); Masao Sakama, Hamamatsu (JP); Yoshimasa Isozaki, Hamamatsu (JP)

(73) Assignee: Yahama Corporation, Hamamatsu (JP)

( * ) Notice: Subject to any disclaimer, the term of this patent is extended or adjusted under 35 U.S.C. 154(b) by 0 days.

(21) Appl. No.: 08/977,727

(22) Filed: Nov. 25, 1997

(30) Foreign Application Priority Data

Nov. 27, 1996 (JP) ..... 8-330206

(51) Int. Cl.[7] ..... G10H 7/00

(52) U.S. Cl. ..... 84/609; 84/610; 84/622; 84/627; 84/649; 84/650; 84/659

(58) Field of Search ..... 84/601–606, 609–612, 84/615, 622–626, 628, 634–636, 627, 629–633, 616, 619, 653–654, 657, 659–666, 649–650

(56) References Cited

U.S. PATENT DOCUMENTS 4,930,390 A * 6/1990 Kellogg et al. ..... 84/611
5,069,105 A * 12/1991 Iba et al. ..... 84/605
5,216,189 A 6/1993 Kato
5,225,617 A * 7/1993 Hotta ..... 84/477 R
5,225,619 A 7/1993 Sharp
5,262,582 A * 11/1993 Hanzawa et al. ..... 84/605
5,298,765 A 3/1994 Nishimoto et al.
5,436,403 A * 7/1995 Usa ..... 84/609
5,446,237 A * 8/1995 Abe et al. ..... 84/617
5,510,572 A 4/1996 Hayashi et al.
5,703,312 A * 12/1997 Takahashi et al ..... 84/626

FOREIGN PATENT DOCUMENTS

GB 2 137 399 10/1984
JP 2-10440 3/1990

* cited by examiner

*Primary Examiner*—Marlon T. Fletcher
(74) *Attorney, Agent, or Firm*—Morrison & Foerster LLP

(57) ABSTRACT

A method of generating musical tones and a storage medium storing a program for executing the method are provided. Musical piece data is decomposed into phrases, the musical piece data being formed of pieces of performance data arranged in the order of performance. The pieces of performance data of the musical piece data are analyzed for each of the phrases obtained by the decomposing step. Tone color control data is prepared for each of the phrases according to results of the analyzing. The pieces of performance data of the musical piece data are reproduced by sequentially reading the pieces of performance data at timing at which the pieces of performance data are to be performed to the order of performance. Tone color characteristics of musical tones to be generated based on selected ones of the pieces of performance data which are reproduced by the reproducing step, are controlled according to the tone color control data prepared for ones of the phrases to which the selected ones of the pieces of performance data belong, respectively.

39 Claims, 17 Drawing Sheets

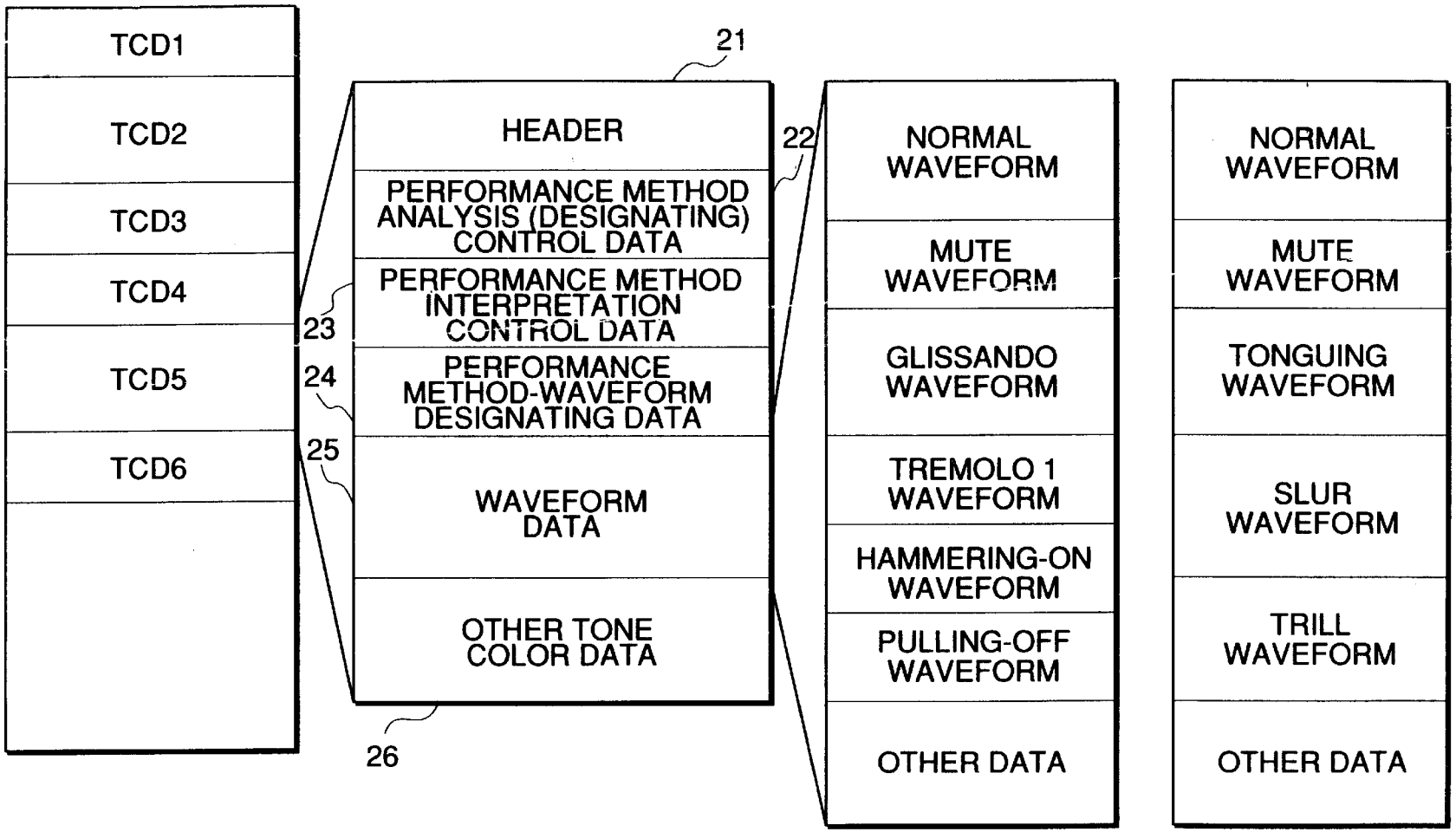
FIG.3A
TCD1
TCD2
TCD3
TCD4
TCD5
TCD6
FIG.3B
21
HEADER
PERFORMANCE METHOD ANALYSIS (DESIGNATING) CONTROL DATA
PERFORMANCE METHOD INTERPRETATION CONTROL DATA
PERFORMANCE METHOD-WAVEFORM DESIGNATING DATA
WAVEFORM DATA
OTHER TONE COLOR DATA
22
23
24
25
26
FIG.3C
NORMAL WAVEFORM
MUTE WAVEFORM
GLISSANDO WAVEFORM
TREMOLO 1 WAVEFORM
HAMMERING-ON WAVEFORM
PULLING-OFF WAVEFORM
OTHER DATA
FIG.3D
NORMAL WAVEFORM
MUTE WAVEFORM
TONGUING WAVEFORM
SLUR WAVEFORM
TRILL WAVEFORM
OTHER DATA

MUSICAL TONE-GENERATING METHOD

BACKGROUND OF THE INVENTION

1. Field of the Invention

The invention relates to a musical tone-generating method for generating waveforms of musical tones based on performance data.

2. Prior Art

Conventionally, tone generators, such as an FM tone generator, a higher harmonic-synthesizing tone generator, and a waveform memory tone generator, generate waveforms of musical tones based on performance data.

For example, in the waveform memory tone generator, when a performance event instructing a start of generation of a musical tone occurs, waveform data of a currently selected tone color is read from a waveform memory at a speed corresponding to a pitch designated by the performance event, whereby a waveform of the musical tone is generated based on the waveform data read from the waveform memory.

However, it is difficult for the conventional tone generators to express musical tones played by performance methods peculiar to natural instruments. When the player plays a musical piece with a natural instrument, he selects the most suitable performance method for playing each phrase of the musical piece from various performance methods peculiar to the natural instrument. Therefore, when the musical piece is played with the natural instrument, the tone color of musical tones naturally varies with the performance method selected for playing each phrase. However, the conventional tone generator mentioned above cannot faithfully express variations in the tone color of the musical tones between performance methods.

SUMMARY OF THE INVENTION

It is an object of the invention to provide a musical tone-generating method which is capable of faithfully expressing variations in the tone color of musical tones between performance methods peculiar to a natural instrument.

To attain the above object, according to a first aspect of the invention, there is provided a method of generating musical tones, comprising a decomposing step of decomposing musical piece data into phrases, the musical piece data being formed of pieces of performance data arranged in order of performance, an analyzing step of analyzing the pieces of performance data of the musical piece data for each of the phrases obtained by the decomposing step, a preparing step of preparing tone color control data for the each of the phrases according to results of the analyzing, a reproducing step of reproducing the pieces of performance data of the musical piece data by sequentially reading the pieces of performance data at timing at which the pieces of performance data are to be performed, and a controlling step of controlling tone color characteristics of musical tones to be generated based on selected ones of the pieces of performance data which are reproduced by the reproducing step, according to the tone color control data prepared for ones of the phrases to which the selected ones of the pieces of performance data belong, respectively.

To attain the above object, according to a second aspect of the invention, there is provided a method of generating musical tones, comprising a first storing step of storing a plurality of pieces of tone color control data corresponding to respective performance methods in tone color control data-storing means, a second storing step of storing performance data in performance data-storing means, a data-generating step of generating performance method data that designates which of the performance methods the performance data corresponds to, a selecting step of selecting one of the pieces of tone color control data which corresponds to the performance method data generated by the data-generating step, a musical tone-generating step of generating a musical tone based on the performance data, and a controlling step of controlling tone color characteristics of the musical tone generated by the musical tone-generating step, according to the selected one of the pieces of tone color control data.

Preferably, the method includes a tone color-selecting step of selecting a kind of tone color of a musical tone to be generated, and a third storing step of storing pieces of the performance method data peculiar to the selected kind of tone color, in performance method data-storing means, the data-generating step selecting and generating a desired piece of performance method data from the pieces of the performance method data peculiar to the kind of tone color selected by the tone color-selecting step, according to the performance data.

Preferably, the pieces of tone color control data each include a plurality of waveform data corresponding respectively to the performance methods.

Preferably, the pieces of tone color control data each include a plurality of sounding control programs corresponding respectively to the performance methods.

To attain the above object, according to a third aspect of the invention, there is provided a method of generating musical tones, comprising a first storing step of storing a plurality of kinds of waveforms for generating glissando waveforms in musical tone waveform-storing means, each of the kinds of waveforms itself having a tone color variation characteristic and a pitch variation characteristic peculiar to a glissando performance method, and comprising an attack portion to be read out first only once and a loop portion to be repeatedly read out after the attack portion is read out, a waveform-designating step of sequentially designating a sequence of waveforms necessary for generating a desired glissando waveform from the plurality of kinds of waveforms stored in the musical tone waveform-storing means, a timing-designating step of designating sounding timing for starting reading of each waveform of the designated sequence of waveforms designated by the timing-designating step, a first reading step of starting reading of the attack portion of the each waveform of the sequence of waveforms, at the designated sounding timing while terminating reading of an immediately preceding waveform being sounded, a second reading step of repeatedly reading the loop portion following the attack portion upon completion of the reading of the attack portion, and a generating step of repeatedly executing the first and second reading steps to sequentially read out the designated sequence of waveforms and generating musical tones based on the designated sequence of waveforms.

To attain the above object, according to a fourth aspect of the invention, there is provided a method of generating musical tones, comprising a storing step of storing a plurality of kinds of waveforms of musical tones which change in pitch between two pitches, in musical tone waveform-storing means, a reading step of selectively reading out waveforms from the plurality of kinds of waveforms stored in the musical tone waveform-storing means, a selecting step of selecting at random one waveform from the plurality of kinds of waveforms of musical tones stored in the musical tone waveform-storing means whenever the selective reading of another waveform of the plurality of kinds of waveforms selected immediately before the selection of the one waveform is terminated, a generating step of generating a musical tone by reading out the waveform selected by the selecting step.

To attain the above object, according to a fifth aspect of the invention, there is provided a method of generating musical tones, comprising a first storing step of storing a plurality of kinds of waveforms of musical tones each having a first characteristic as a first musical tone waveform group in first waveform-storing means, a second storing step of storing a plurality of kinds of waveforms of musical tones each having a second characteristic as a second musical tone waveform group in second waveform-storing means, a selecting step of selecting a waveform alternately from the first musical tone waveform group and the second musical tone waveform group, and a generating step of generating a musical tone by reading out the waveform selected by the selecting step.

To attain the above object, according to a sixth aspect of the invention, there is provided a storage medium that stores a program that can be carried out by a computer, comprising a decomposing module that decomposes musical piece data into phrases, the musical piece data being formed of pieces of performance data arranged in order of performance, an analyzing module that analyzes the pieces of performance data of the musical piece data for each of the phrases obtained by execution of the decomposing module, a preparing module that prepares tone color control data for the each of the phrases according to results of the analyzing, a reproducing module that reproduces the pieces of performance data of the musical piece data by sequentially reading the pieces of performance data at timing at which the pieces of performance data are to be performed to the order of performance, and a controlling module that controls tone color characteristics of musical tones to be generated based on selected ones of the pieces of performance data which are reproduced by execution of the reproducing module, according to the tone color control data prepared for ones of the phrases to which the selected ones of the pieces of performance data belongs, respectively.

To attain the above object, according to a seventh aspect of the invention, there is provided a storage medium that stores a program that can be carried out by a computer, comprising a first storing module that stores a plurality of pieces of tone color control data corresponding to respective performance methods in tone color control data-storing means, a second storing module that stores performance data in performance data-storing means, a data-generating module that generates performance method data that designates which of the performance methods the performance data corresponds to, a selecting module that selects one of the pieces of tone color control data which corresponds to the performance method data generated by execution of the data-generating module;

a musical tone-generating module that generates a musical tone based on the performance data, and a controlling module that controls tone color characteristics of the musical tone generated by execution of the musical tone-generating module, according to the selected one of the pieces of tone color control data.

To attain the above object, according to an eighth aspect of the invention, there is provided a storage medium that stores a program that can be carried out by a computer, comprising a first storing module that stores a plurality of kinds of waveforms for generating glissando waveforms in musical tone waveform-storing means, each of the kinds of waveforms itself having a tone color variation characteristic and a pitch variation characteristic peculiar to a glissando performance method, and comprising an attack portion to be read out first only once and a loop portion to be repeatedly read out after the attack portion is read out, a waveform-designating module that sequentially designates a sequence of waveforms necessary for generating a desired glissando waveform from the plurality of kinds of waveforms stored in the musical tone waveform-storing means, a timing-designating module that designates sounding timing for starting reading of each waveform of the designated sequence of waveforms designated by execution of the timing-designating module, a first reading module that starts reading of the attack portion of the each waveform of the designated sequence of waveforms, at the designated sounding timing while terminating reading of an immediately preceding waveform being sounded, a second reading module that repeatedly reads the loop portion following the attack portion upon completion of the reading of the attack portion, and a generating module that repeatedly executes the first and second reading module to sequentially read out the designated sequence of waveforms and generating musical tones based on the designated sequence of waveforms.

To attain the above object, according to a ninth aspect of the invention, there is provided a storage medium that stores a program that can be carried out by a computer, comprising a storing module that stores a plurality of kinds of waveforms of musical tones which change in pitch between two pitches, in musical tone waveform-storing means, a reading module that selectively reads out waveforms from the plurality of kinds of waveforms stored in the musical tone waveform-storing means, a selecting module that selects at random one waveform from the plurality of kinds of waveforms of musical tones stored in the musical tone waveform-storing means whenever the selective reading of another waveform of the plurality of kinds of waveforms selected immediately before the selection of the one waveform is terminated, and a generating module that generates a musical tone by reading out the waveform selected by execution of the selecting module.

To attain the above object, according to a tenth aspect of the invention, there is provided a storage medium that stores a program that can be carried out by a computer, comprising a first storing module that stores a plurality of kinds of waveforms of musical tones each having a first characteristic as a first musical tone waveform group in first waveform-storing means, a second storing module that stores a plurality of kinds of waveforms of musical tones each having a second characteristic as a second musical tone waveform group in second waveform-storing means, a selecting module that selects a waveform alternately from the first musical tone waveform group and the second musical tone waveform group, and a generating module that generates a musical tone by reading out the waveform selected by execution of the selecting module.

The above and other objects, features, and advantages of the invention will become more apparent from the following detailed description taken in conjunction with the accompanying drawings.

BRIEF DESCRIPTION OF THE DRAWINGS

FIGS. 3A to 3D are diagrams showing an example of a plurality of tone color data stored in a hard disk in a hard disk drive appearing in FIG. 1 and data formats thereof;

DETAILED DESCRIPTION

Now, the invention will be described in detail with reference to the drawings showing an embodiment thereof.

Figure 1:
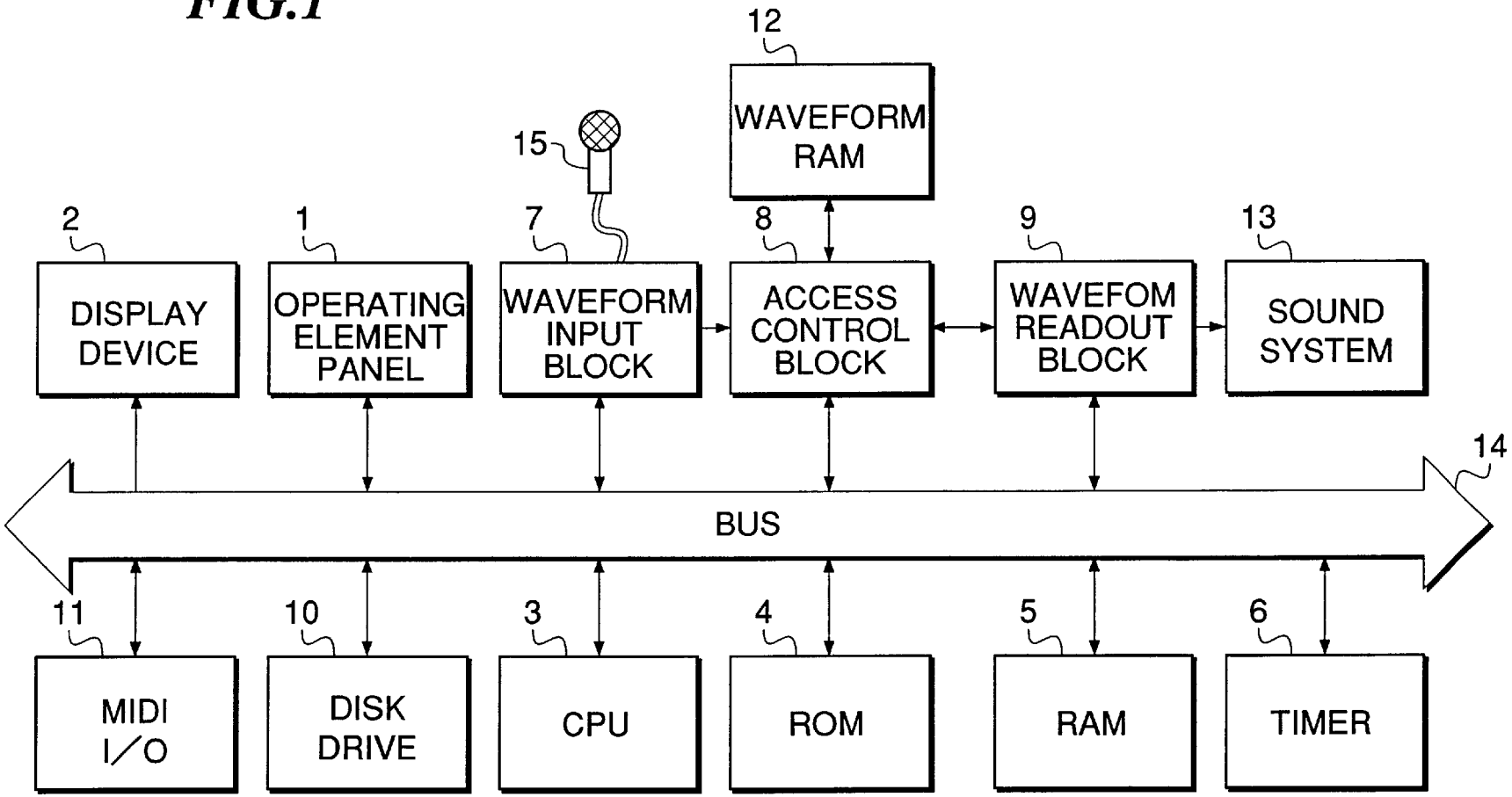
FIG. 1 is a block diagram showing the whole arrangement of a musical tone-generating apparatus to which a musical tone-generating method according to an embodiment of the invention is applied.

Referring first to FIG. 1, there is shown the whole arrangement of a musical tone-generating apparatus to which is applied a musical tone-generating method according to an embodiment of the invention.

As shown in the figure, the musical tone-generating apparatus of the present embodiment is comprised of an operating element panel 1 for instructing sampling of musical tones, editing sampled waveform data and the like, inputting various kinds of information, and so on, a display device 2 for displaying the various kinds of information input via the operating element panel 1, the sampled waveform data, etc., a CPU 3 for controlling the operation of the whole musical tone-generating apparatus, a ROM 4 storing control programs executed by the CPU 3 and data of tables to which the CPU 3 refers, a RAM 5 for temporarily storing results of operations of the CPU 3, various kinds of information input via the operating element panel 1, etc., a timer 6 for measuring time intervals of execution of timer interrupt routines executed by the CPU 3 and various kinds of times, a waveform input block 7 which incorporates an A/D (analog to digital) converter and operates to convert (sample) an analog musical tone signal input via a microphone 15 into digital basic waveform data (waveform data as a material of musical tone waveform data to be output) and write the converted data into a waveform RAM 12, an access control block 8 for controlling access to the waveform RAM 12 to write waveform data therein and access to the same to read waveform data therefrom such that no collision occurs between the two kinds of accesses, a waveform readout block 9 for accessing the waveform RAM 12 via the access control block 8 to read waveform data therefrom, a disk drive 10 for driving a disk for storing waveform data, information related to the waveform data (performance method analysis control data, performance method interpretation data, performance method waveform-designating data, etc. referred to hereinafter), a plurality of kinds of tone color data comprised of various tone color parameters and the like, various kinds of application programs including control programs executed by the CPU 3, performance data (musical piece data) prepared in advance, etc., and a MIDI interface (I/O) 11 for inputting a MIDI (Musical Instrument Digital Interface) signal (code) received from an external electronic musical instrument and delivering a MIDI signal to an external electronic musical instrument or the like.

The above components 1 to 11 are connected to each other via a bus 14. A microphone 15 is connected to the waveform input block 7, which has an output thereof connected to an input of the access control block 8. The access control block 8 is connected to the waveform RAM 12 and the waveform readout block 9, and the access control block 8 has an output thereof connected to an input of a sound system 13 comprised of an amplifier and a loudspeaker.

The disk drive 10 can drive various storage media which include a hard disk, a floppy disk, a CD-ROM, a magneto-optical disk, etc. However, the following description will be made on assumption that a hard disk is driven by the disk drive 10.

The waveform readout block 9 incorporates a tone generator and a D/A (digital to analog) converter, neither of which is shown. When performance data is reproduced to cause a note-on event to occur, and a musical tone-generating channel is determined for the note-on event, i.e. channel assignment is carried out, settings for reading out the basic waveform data, which corresponds to the note-on event, and other settings of musical tone parameters are made to the musical tone-generating channel. The waveform readout block 9 reads out the basic waveform data from the waveform RAM 12 according to the former settings for reading out the basic waveform data, while the tone generator controls the frequency characteristic, amplitude characteristic, etc. of the read waveform data according to the latter settings for musical tone parameters, whereby digital musical tone waveform data to be output is generated. The D/A converter converts the digital musical tone waveform data into an analog musical tone signal and delivers the resulting signal to the sound system 13. The sound system 13 converts the analog musical tone signal into sounds.

Figure 2:
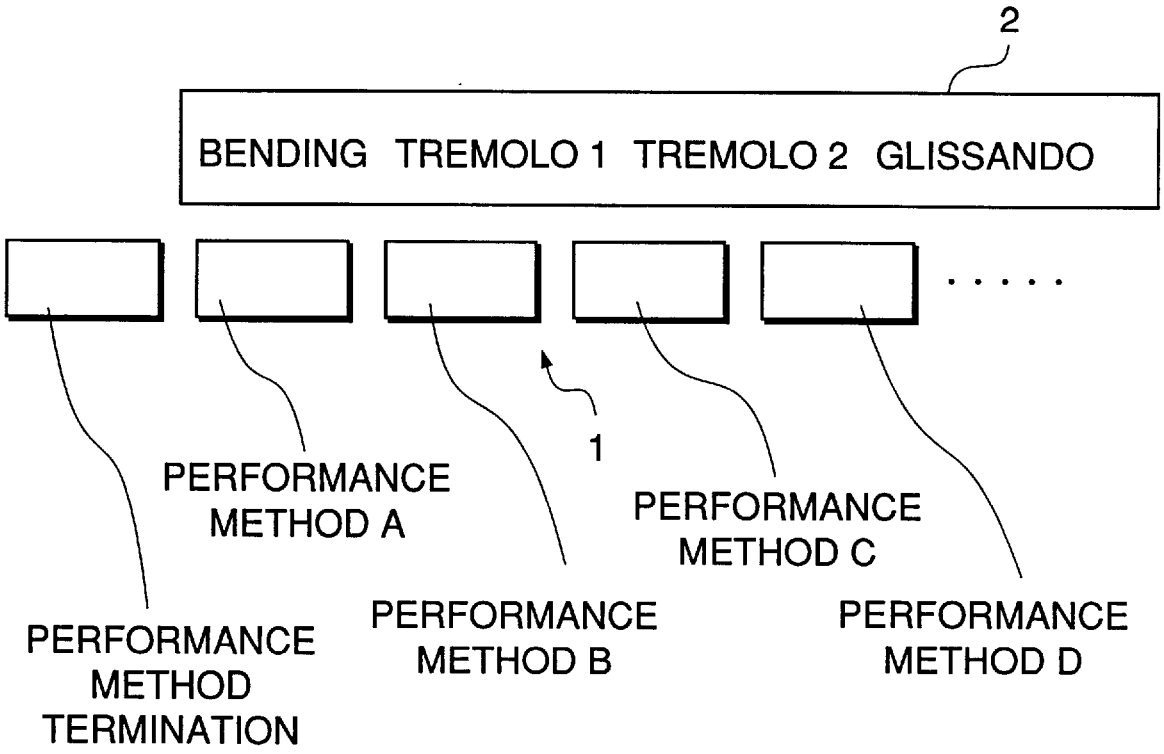
FIG. 2 is a diagram showing various switches arranged on an operating element panel and an example of information displayed on a display device.

FIG. 2 shows various switches arranged on the operating element panel 1 and an example of information displayed on the display device 2. The figure illustrates what is displayed on the display device 2 when a performance method-setting mode is selected which enables the player to manually set various performance methods to performance information.

As shown in the figure, the operating element panel 1 has performance method-setting switches for manually setting a performance method (selected from performance methods A, B, C, D, . . . ) for each of phrases obtained by dividing performance data, as described hereinafter, and a performance method termination switch for canceling the performance method set by any of the performance method-setting switches, i.e. for setting a no-performance method-selected state. The display 2 displays various kinds of performance methods which can be selected for the tone color currently selected (in the illustrated example, "bending" "tremolo 1", "tremolo 2", and "glissando"), in a manner corresponding respectively to the performance method-setting switches. The player can add an performance method to performance information as desired by depressing a switch corresponding to the performance method at a point of the performance where he wishes to add the performance method thereto.

FIGS. 3A to 3D show an example of a plurality of tone color data TCDk stored in the hard disk of the disk drive 10 and data formats thereof. In the figures, FIG. 3A shows an arrangement in which the tone color data TCDk (k=1, 2, 3, . . . ) are stored in the hard disk, FIG. 3B shows a data format of an item TCD5 of the tone color data, FIG. 3C show an example of various kinds of waveform data obtained by sampling and processing musical tones generated by various guitar performance methods and stored in the hard disk, assuming that the tone color data TCD5 is tone color data of guitar, and FIG. 3D shows an example of various kinds of waveform data obtained and stored similarly to the FIG. 3C example, assuming that the tone color data TCD5 is tone color data of flute.

The other items of the tone color data TCDk are each formed in the same data format as that of the tone color data TCD5. The data format is comprised of a header area 21 storing a tone color name, a data volume, etc., performance method analysis (or designation) control data area 22 storing information indicative of kinds of performance method supported by the tone color data, in other words, information indicative of kinds of performance methods employed by a natural instrument corresponding to a tone color which the tone color data represents (this information is referred in the present embodiment as "performance method code"), and information indicative of which kind of performance method should be properly assigned to performance information (e.g. a sequence of performance data) when a performance method code indicative of the performance method is to be assigned to the performance information which has no performance method code assigned thereto, a performance method interpretation data area 23 storing performance method interpretation information for determining how to process and control parameters of the performance information according to a performance method code assigned to the performance information, a performance method waveform-designating data area 24 storing performance method waveform-designating data for correlating each performance method code to each of waveform data obtained by sampling and processing musical tones and stored in a waveform data area 25, the waveform data area 25 storing the waveform data, and an other tone color data area 26 storing other tone color data.

If the tone color data TCD5 is data for reproducing musical tones having a tone color of guitar, for instance, musical tone waveforms generated by an acoustic guitar actually played with various performance methods, including a normal waveform generated when the guitar is played by a normal performance method, a mute waveform generated when the same is played by a mute performance method, a glissando waveform generated when the same is played by a glissando performance method, a tremolo waveform generated when the same is played by a tremolo performance method, a hammering-on waveform generated when the same is played by a hammering-on performance method, and a pulling-off waveform generated when the same is played by a pulling-off performance method, are sampled, processed, and stored in the waveform data area 25 as shown in FIG. 3C. Further, the waveform data area 25 stores other data required for reproducing such various kinds of waveforms as mentioned above.

Further, if the tone color data TCD5 is data for reproducing musical tones having a tone color of flute, for instance, musical tone waveforms generated by an acoustic flute actually played with various performance methods, including a normal waveform generated when the flute is played by a normal performance method, a short waveform generated when the same is played for a short time period, a tonguing waveform generated when the same is played by a tonguing performance method, a slur waveform generated when the same is played by a slur performance method, and a trill waveform generated when the same is played by a trill performance method, are sampled, processed, and stored in the waveform data area 25, as shown in FIG. 3D. Similarly to FIG. 3C, the waveform data area 25 stores other data.

The tone color data TCDk thus stored in the hard disk is read out according to a tone color designated by the player, and loaded into the waveform RAM 12.

Figure 4:
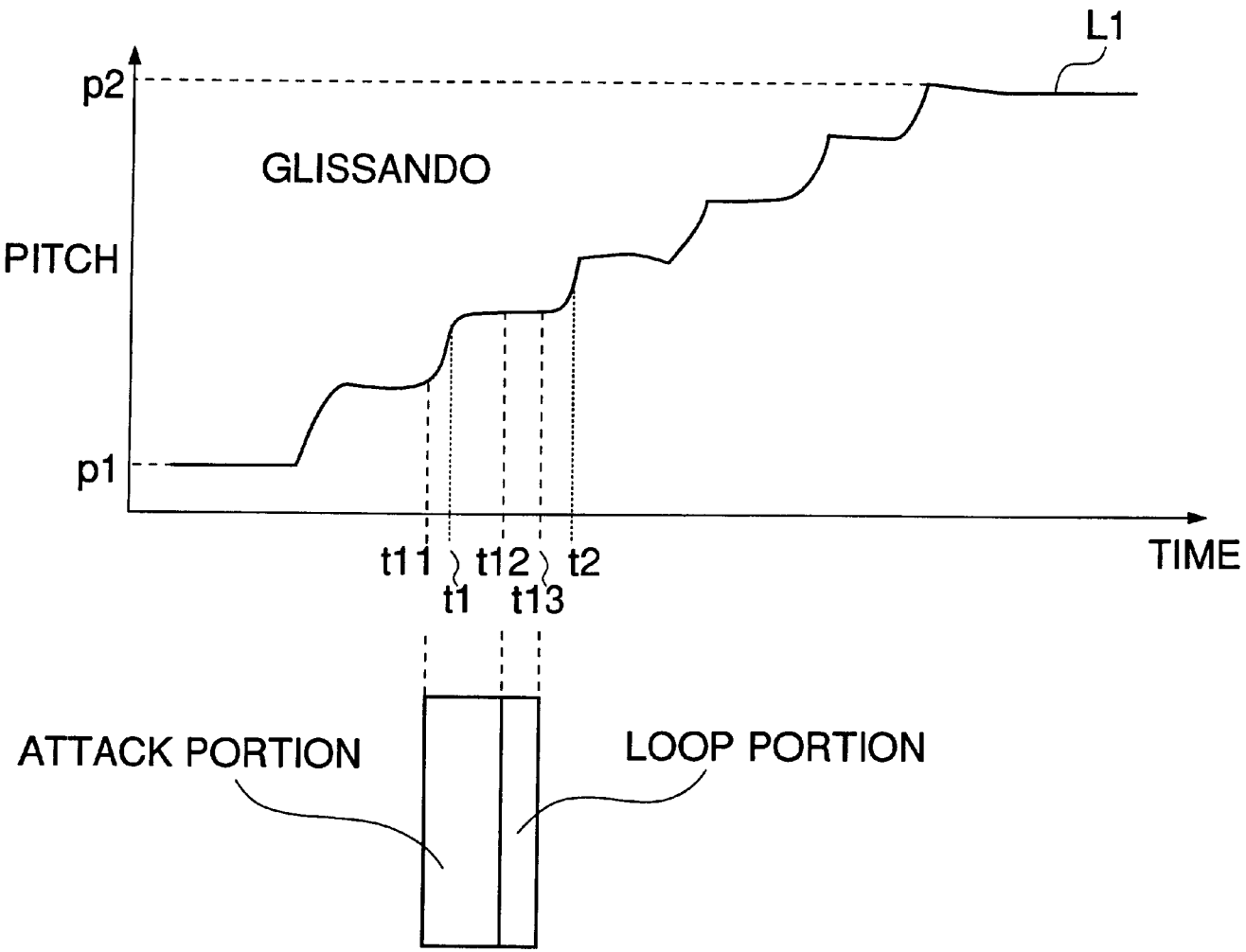
FIG. 4 is a diagram which is useful in explaining a manner of forming glissando waveform data stored in a waveform data area appearing in FIG. 3.

Now, a manner of preparing glissando waveform data for storage in the waveform data area 25 will be described with reference to FIG. 4. In the figure, the ordinate represents pitch, and the abscissa time, while the solid line L1 represents changes in the pitch of raw or unprocessed waveform data obtained by sampling a musical tone waveform actually generated when the guitar is played by the player by a glissando performance method from a pitch p1 to a pitch p2.

From the raw waveform data thus obtained by sampling, waveform data is cut out for each note (in the illustrated example, waveform data corresponding to a time period from a time point t11 to a time point t13 is cut out), to thereby prepare glissando waveform data for each note, which has an attack portion formed by part of the cut-out waveform data (between time points t11 and t12 in the illustrated example), and a loop portion formed by the remaining part of the same (between time points t12 and t13 in the illustrated example). The glissando waveform data in FIG. 3C is formed by a combination of a plurality of pieces of glissando waveform data prepared for respective notes.

When a musical tone is to be generated which is imparted with the effect of glissando between pitches designated by the player, first, sounding is started from a certain note, i.e. a note at a start pitch designated by the player. Then, sounding of a note corresponding to a pitch higher by one note than the pitch of the note being sounded is instructed whenever a predetermined time period elapses, and at the same time, damping of the note being sounded is instructed. Thereafter, the same process is repeatedly carried out over a time period indicated by a glissando continuation beat number set for the glissando performance, i.e. the number of beats over which the glissando performance should be continued. When the sounding of the note corresponding to the start pitch is instructed, an attack portion of normal waveform data corresponding to this note instead of glissando waveform data prepared for each note is first read out, and then reading of a loop portion of the normal waveform data is started. The reading of the loop portion is repeatedly carried out up to a time point at which a predetermined time periods $\alpha$ elapses from a time point at which sounding of the following note was instructed, i.e. until a time point at which the volume of the present note is reduced below a predetermined threshold value (which may be "0") after damping of the present note (for progressive reduction of the volume through control of the volume EG) was instructed simultaneously with instruction of the sounding of the following note. On the other hand, over the predetermined time periods $\alpha$ after the time point the sounding of the following note was instructed, an attack portion of glissando waveform data of the following note sounding of which was instructed is read out, and then a loop portion of the same starts to be read out. Hereafter, sounding of a note corresponding to a pitch higher by one note than the pitch of the note being sounded is instructed whenever the predetermined time period elapses, and in response thereto, glissando waveform data (attack portion+loop portion) corresponding to the note of which the sounding has been instructed is read out. This process is repeatedly carried out until one of the designated pitches (end pitch) at which the glissando performance is to be terminated is reached. The above process will be described in further detail hereinafter with reference to FIGS. 12 and 13.

As described above, according to the present embodiment, separate pieces of glissando waveform data for respective notes are joined to each other (except that normal waveform data is used at the start) to thereby simulate a glissando performance. To smoothly join together glissando waveform data of adjacent notes, glissando waveform data for each note is formed using part of glissando waveform of the immediately preceding note, i.e. a musical tone waveform portion between the time points t11 and t1, rather than using only an actual glissando waveform of each note (represented by a musical tone waveform between the time points t1 and t2 in the illustrated example).

Although in the present embodiment, glissando waveform data for each note is prepared by playing the guitar by the glissando performance method in the direction of the pitch being increased (pitch-increasing direction), this is not limitative, but it goes without saying that glissando waveform data for each note in the direction of the pitch being lowered (pitch-decreasing direction) may be prepared in the same manner as described above for storage in the waveform data area 25.

Now, ways of preparing trill waveform data for storage in the waveform data area 25 will be described with reference to FIGS. 5A to 5E. In the figure, the ordinate represents pitch, while the abscissa represents time.

Figures 5A, 5B, 5C, 5D, 5E:
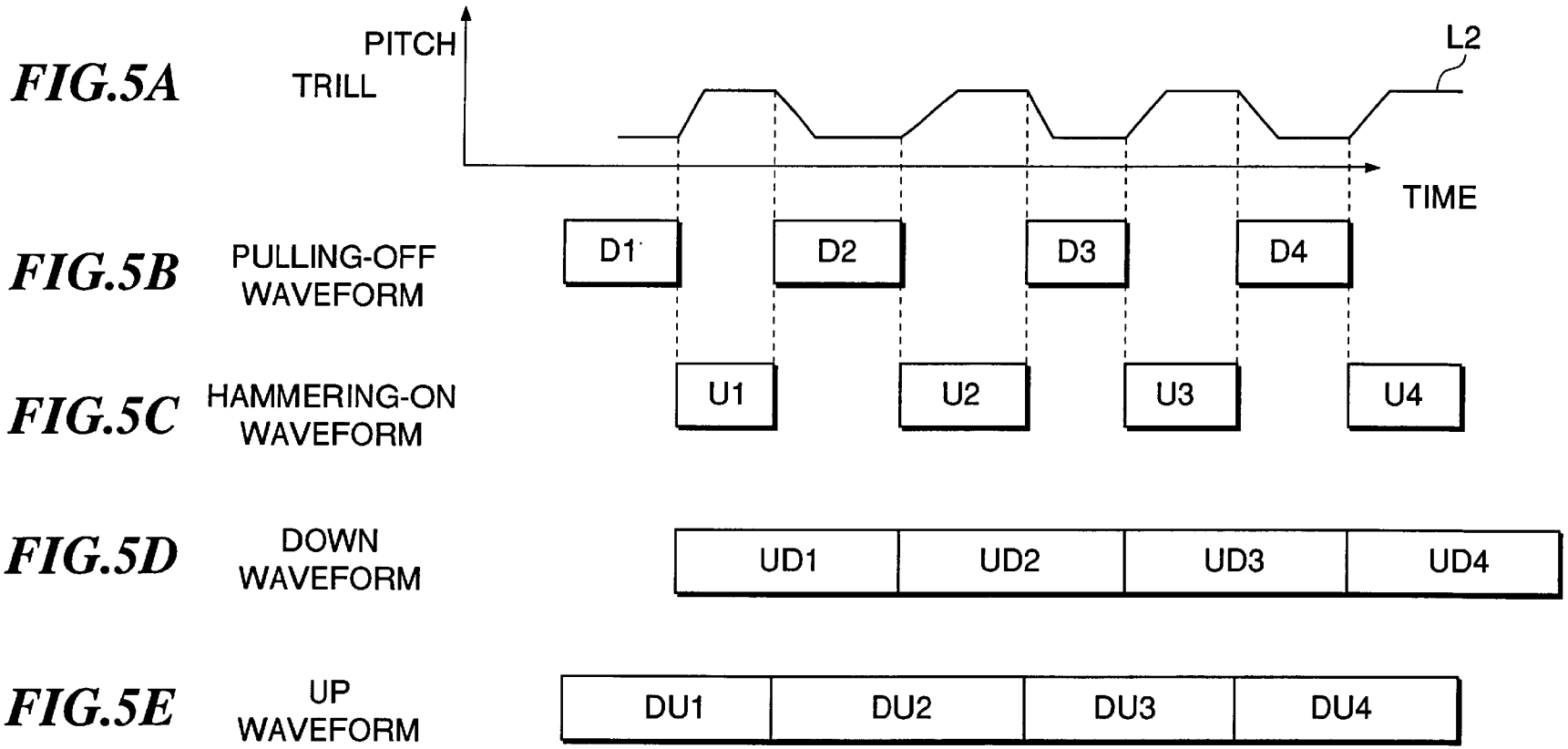
FIGS. 5A to 5E are diagrams which are useful in explaining a manner of forming trill waveform data stored in a waveform data area appearing in FIG. 3.

FIG. 5A shows changes in the pitch of raw or unprocessed trill waveform data (indicated by the solid line L2) obtained by sampling a waveform of musical tone generated by a guitar actually played by a trill performance using the performance methods of pulling-off and pulling-on. FIG. 5B shows pulling-off waveform data obtained by cutting out portions mainly including lower pitch portions of the FIG. 5A waveform in which higher pitch portions and lower pitch portions occur in an alternating manner. Each piece of the pulling-off waveform data contains a joint portion which continues from the end of a waveform of the immediately preceding higher pitch portion. FIG. 5C shows hammering-on waveform data obtained by cutting out portions mainly including higher pitch portions of the FIG. 5A waveform data. Each piece of the hammering-on waveform data contains a joint portion which continues from the end of a waveform of the immediately preceding lower pitch portion. FIG. 5D shows musical tone waveform data obtained by cutting out portions each constituted by a lower pitch portion, the following higher pitch portion, and the following lower pitch portion, i.e. a portion corresponding to a hammering-on portion and the following pulling-off portion (hereinafter referred to as "down waveform data"), while FIG. 5E shows musical tone waveform data obtained by cutting out portions each constituted by a higher pitch portion, the following lower pitch portion, and the following higher pitch portion, i.e. a portion corresponding to a pulling-off portion and the following hammering-on portion (hereinafter referred to as "up waveform data").

As shown in FIG. 5B, a plurality of pieces Dk (k=1, 2, . . . ) of pulling-off waveform data are cut out from the sampled trill waveform to form a pulling-off waveform group, which is stored in the waveform data area 25. In generating trill, pieces Dk of the pulling-off waveform data are sounded, which are selected at random from the pulling-off waveform group, as described hereinafter. This is because the pieces Dk of the pulling-off waveform data are delicately different in duration, tone color, etc., from each other, and therefore a musical tone having a pulling-off waveform which is more free of mannerism can be produced by selecting at random pieces of pulling-off waveform data from the pulling-off waveform group and sounding the same, than by repeatedly reading out only one of the pieces Dk of the pulling-off waveform data and sounding the same.

Similarly, as shown in FIG. 5C, a plurality of pieces Uk (k=1, 2, . . . ) of hammering-on waveform data are cut out from the sampled trill waveform to form a hammering-on waveform group, which is stored in the waveform data area 25. Then, in generating the trill, similarly to the pulling-off waveform data which is used for generating trill, pieces Uk of the hammering-on waveform data are sounded, which are selected at random from the hammering-on waveform group. This is because the pieces Uk of the hammering-on waveform data are delicately different in duration, tone color, etc., from each other.

Hereafter, the manner of generating musical tones by using the pulling-off waveform data Dk and the hammering-on waveform data Uk will be referred to as "the trill 2 method".

As shown in FIG. 5D, a plurality of pieces UDk (k=1, 2, . . . ) of down waveform data each formed by a main portion which shifts from a higher pitch portion to the following lower pitch portion, and a joint portion continuing from the end of the immediately preceding lower pitch portion are cut out from the raw or unprocessed trill waveform data, and the plurality of pieces of down waveform data thus prepared form a down waveform group, which is stored in the waveform data area 25. It should be noted that the above manner of forming the down waveform data UDk is not limitative, but one piece of waveform data may be selected from each of the hammering-on waveform data group and the pulling-off waveform data group, and the thus selected two pieces of waveform data may be joined together in this order to form a piece of down waveform data.

Similarly, as shown in FIG. 5E, a plurality of pieces DUk (k=1, 2, . . . ) of up waveform data formed by a main portion which shifts from a lower pitch portion to the following higher pitch portion, and a joint portion continuing from the end of the immediately preceding higher pitch portion are cut out from the raw or unprocessed trill waveform data, and the plurality of pieces of down waveform data thus prepared form an up waveform group, which is stored in the waveform data area 25. It should be noted that the above manner of forming the down waveform data DUk is not limitative, but one piece of waveform data may be selected from each of the pulling-off waveform data group and the hammering-on waveform data group, and the thus selected two pieces of waveform data may be joined together in this order to form a piece of up waveform data.

In the present embodiment, musical tones of a trill performance are generated by using pieces of waveform data UDk or DUk forming the down waveform group or the up waveform group. This manner of generating musical tones will be hereinafter referred to as "the trill 1 method". The generation of musical tones by the trill 1 method is also carried out similarly to the trill 2 method, i.e. by sounding pieces UDk or DUk of the waveform data which are selected at random from a corresponding one of the down waveform group and the up waveform group.

Although in the present embodiment, the trill 1 method, similarly to the trill 2 method, uses part of the raw trill waveform data, this is not limitative, but the up waveform data and the down waveform data may be prepared by recording (sampling) musical tones of guitar generated by a trill performance using a performance method of picking and generated based on the up waveform data and the down waveform data thus prepared.

Now, the manner of assigning performance method codes to performance information prepared in advance will be described with reference to FIGS. 6A, 6B, 7A and 7B.

Figure 6A:
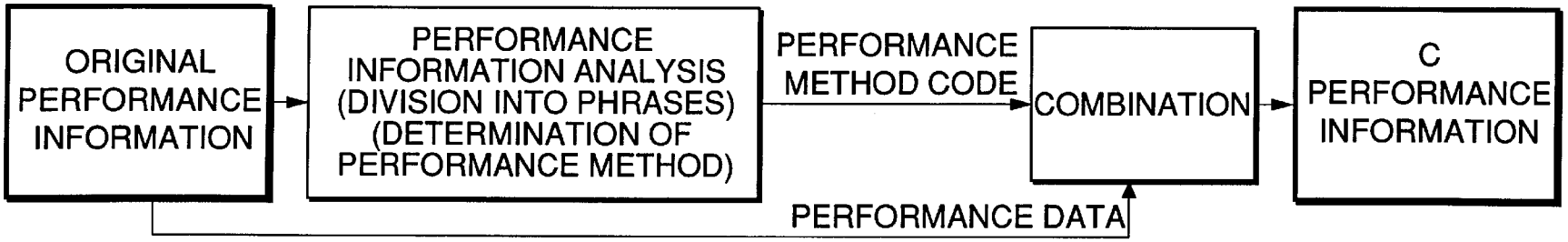
FIGS. 6A and 6B are block diagrams which are useful in explaining a manner of assigning a performance method code to performance information.
Figure 6B:
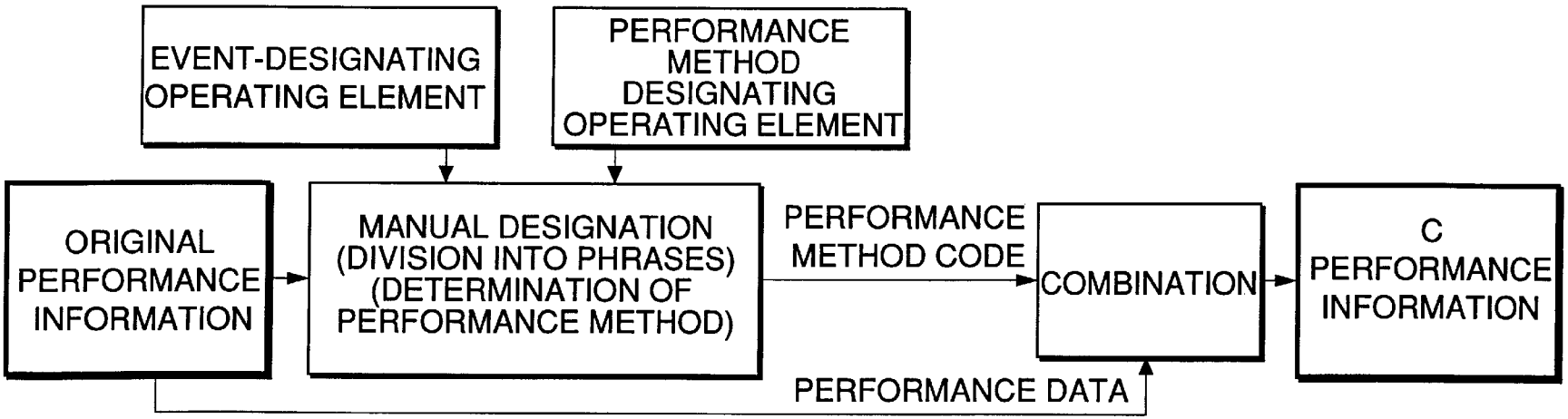
Figure 7B:
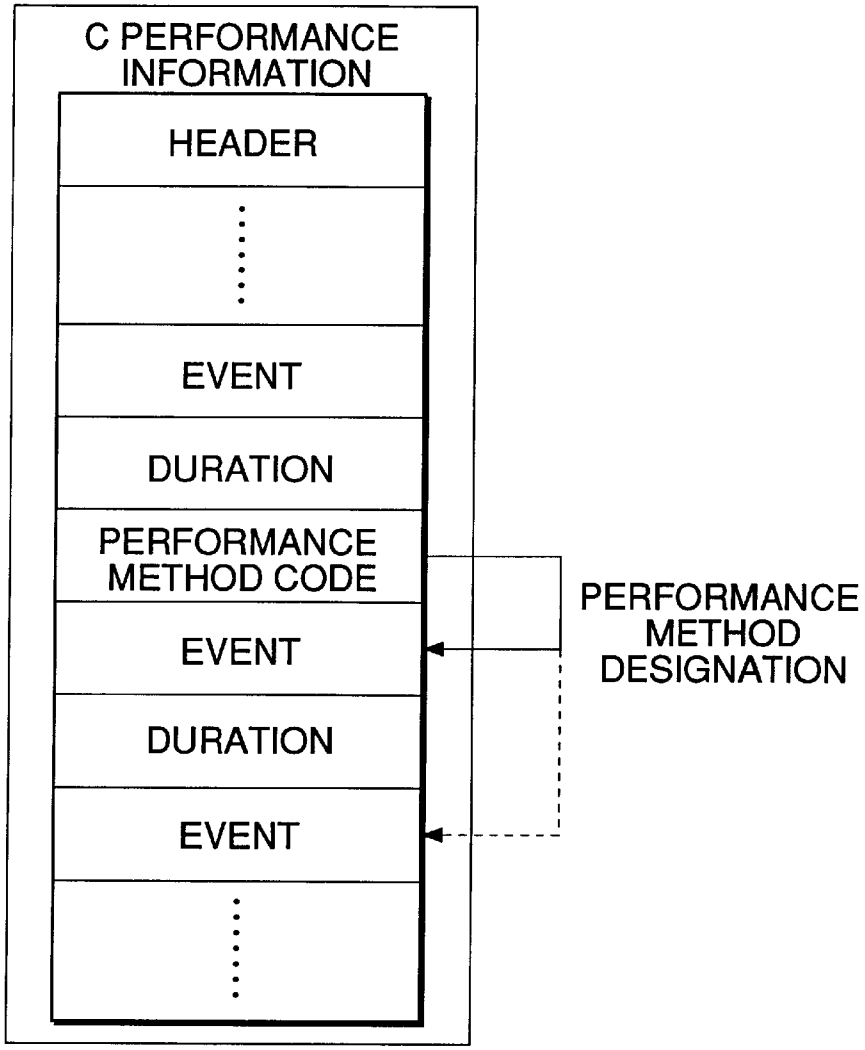
FIGS. 7A and 7B are diagrams showing a data format of performance information and a data format of performance information to which the performance method code is added, respectively.
Figure 7A:
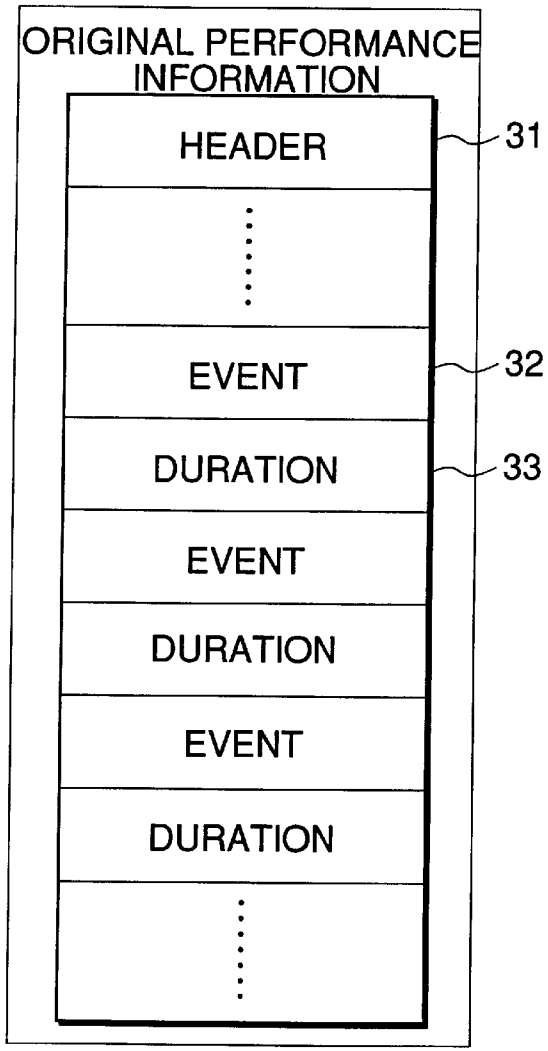

FIGS. 6A and 6B illustrate methods of assigning performance method codes to the performance information. FIG. 6A shows a method of automatically assigning performance method codes to the performance information, while FIG. 6B shows a method of manually assigning performance method codes to the same. FIGS. 7A and 7B shows a data format of performance information and a data format of performance information having performance method codes assigned thereto, respectively.

A plurality of pieces of performance information (hereinafter referred to as "original performance information SMF (Standard MIDI File)") prepared by a player or a person other than the player are stored in a predetermine area of the hard disk in file format, and from these files, in response to instructions by the player, pieces of performance information (MIDI file) are selected and loaded into an original performance information SMF storage area provided at a predetermined location of the RAM 5.

The original performance information SMF as shown in FIG. 7A, is formed of header data 31 comprised e.g. of title of a musical piece, date of preparation of the musical piece, initialization data, such as initial tempo, and volume of performance information, event data 32 comprised e.g. of key-on events, key-off events, and velocity data, and duration data 33 indicative of timing of reproduction of each piece of event data.

To assign a performance method code to original performance information SMF in an automatic manner, as shown in FIG. 6A, first, performance information analysis is carried out. That is, data of the original performance information SMF are sequentially read out and analyzed, and according to results of the analysis, the original performance information is divided into phrases, based on which performance methods by which the musical piece is to be played are determined. Then, performance method codes corresponding to the determined performance methods are output. More specifically, the performance information analysis is carried out by analyzing a sequence of notes represented by event data and duration data in the original performance information, based on the performance method analysis control data 22 set for a tone color (timbre) currently designated, and according to results of the analysis, the sequence is divided into portions (phrases) which are to be played by respective identical performance methods, and a performance method code indicative of the kind of a performance method of each phrase is generated. The performance method code is formed of data indicative of the name of a performance method to be assigned, event data to which the performance method is to be assigned, parameters required for generating a musical tone according to the performance method, and the number of beats over which the performance method is to be continued (the aforementioned glissando continuation beat number if the performance method is glissando).

If the original performance information SMF for analysis is for guitar, the performance method is determined e.g. in the following manner:

1) A portion at which instructions are issued for alternately sounding two notes having respective pitches different from each other by a half note or a full-note is to be reproduced by a trill performance.

2) A portion at which instructions are issued for sounding notes such that the pitch is increased or decreased at short time intervals is to be reproduced by a glissando performance.

Further, if the original performance information SMF for analysis is for flute, the performance method is determined e.g. in the following manner:

1) A portion at which instructions are issued for sounding notes having a legato or gently changing sequence of pitches is to be reproduced by a slur performance.

The performance method codes thus output are combined with the data of the original performance information SMF and stored as C (combined) performance information CMF in a C performance information storage area provided at a predetermined location of the RAM 5. More specifically, at a predetermined location of the original performance information shown in FIG. 7A, the performance method codes generated by the performance information analysis are inserted, to thereby generate C performance information CMF as shown in FIG. 7B. The performance method codes are each stored at a location prior to the event data for which the performance method code is to be designated, and each designate the kind of a performance method to be designated and one or more pieces of event data in the sequence of notes to be played back by the performance method.

On the other hand, to manually assign performance method codes to original performance information, as shown in FIG. 6B, data of the original performance information are sequentially read out and displayed as a score on the display device 2, and the user determines which portion of the displayed score should be suitably played by which performance method while viewing the sequence of notes, not shown, of the original performance information SMF of the displayed score. Based on results of the determination, the user operates an event-designating operating element, not shown in FIG. 2, to divide the sequence into phrases which are to be played by respective performance methods, and designates the kinds of performance methods by operating a performance method-designating operating element (performance method switches in FIG. 2), whereby the performance method codes corresponding to the performance methods are output. The performance method codes are combined with the original performance information SMF and stored as C performance information CMF in the C performance information storage area.

The performance method codes are, as mentioned above, data for designating which of events in the sequence of notes should be played by which kind of performance method, and additionally contain data indicative of a length of time over which the designated performance method should continue to be used as well as parameters for designating details of the manner of carrying out the performance method provided for each of the designated kinds of performance method.

These parameters include, e.g. a "speed parameter" and a "curve parameter" which designate a manner of instructing sounding of musical tones which are generated by a glissando performance at predetermined time intervals such that one musical tone is higher (or lower) than the immediately preceding one by a half note or a full note. The "speed parameter" is for controlling an average value of the time intervals (average speed) of generation of musical tones by the glissando performance while the "curve parameter" is for controlling variation of the time intervals of generation of musical tones, for instance, such that the time intervals are shorter during a first half of the glissando performance and longer during a latter half of the same. That is, the "speed parameter" and the "curve parameter" control the frequency of generation of sounding instructions which are sequentially generated.

If the performance method is trill based on the trill 1 method, the performance method code therefor contains a "speed parameter" for controlling an average value of time intervals at which instructions are given for sounding musical tones having upper and lower pitches in an alternating manner by a trill performance, a "curve parameter" for controlling variation of the time intervals, an "up/down parameter" for determining which of the up waveform data and the down waveform data is to be used, and so on.

Further, when a performance by the guitar is reproduced, two notes played in succession can be expressed by the performance method of bending. Therefore, a second note played by bending may be realized by bending waveform data prepared by sampling a waveform of an actual bending performance. Also in the case of the performance method of bending, the performance method code contains a "speed parameter" and a "curve parameter". The "speed parameter" in this case represents a time interval between the start of bending and a transition to a sound after the bending, while the "curve parameter" represents changes in pitch during the time interval. To make the bending waveform data agree with the "speed parameters and the "curve parameter", a time stretch method may be employed in which waveform data is stretched or shortened along time axis while maintaining pitches thereof.

Thus, different kinds of parameters are provided for respective performance method codes depending on the kinds of instruments to be simulated and performance methods to be assigned.

These parameters may be automatically set according to time intervals of occurrence of events and the like obtained by analyzing the event data per se designated by a performance method code therefor and duration data therebetween, or alternatively, set by the user, parameter by parameter, by operating an operating element therefor, not shown.

Now, an outline of a control process carried out by the musical tone-generating apparatus constructed as above will be described with reference to FIG. 8, and then the control process will be described in further detail with reference to FIGS. 9 to 17.

Figure 8:
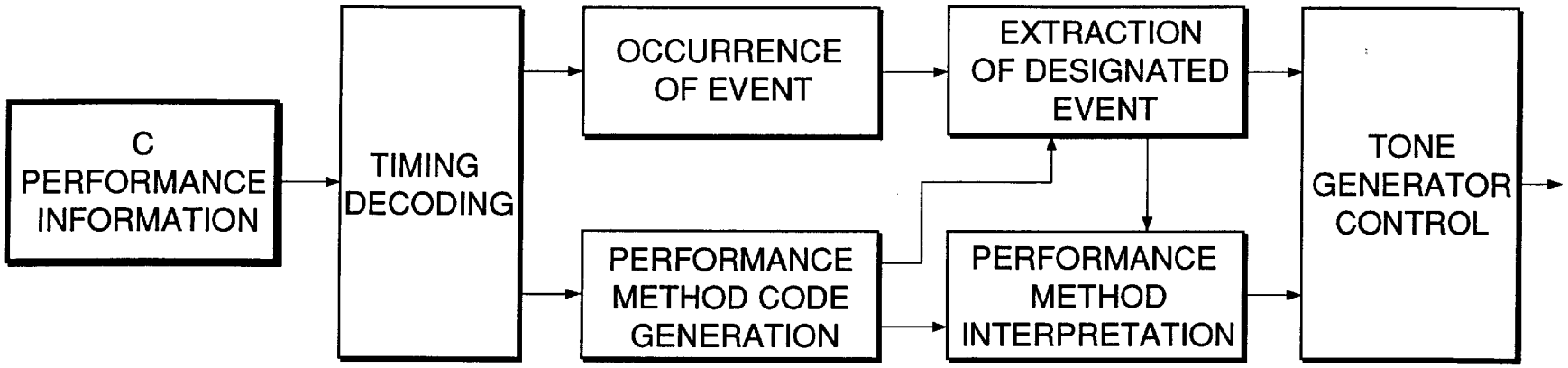
FIG. 8 is a block diagram which is useful in explaining an outline of a control process carried out by the musical tone-generating apparatus according to the embodiment.

FIG. 8 illustrates how an automatic performance process is carried out by the musical tone-generating apparatus according to the present embodiment based on C performance information CMF.

As shown in the figure, data of the C performance information CMF stored in the C performance information storage area is read out, piece by piece, and subjected to timing decoding. The timing decoding is a process for reading out the data such that when a piece of data read out is duration data, the following piece of data is permitted to be read out after waiting for the lapse of a time period corresponding to duration designated by the duration data. The process of time decoding is carried out by modifying the value of the duration data according to a value of tempo data stored in the header area 31, and inhibiting the reading of the C performance information CMF until the modified value of the duration data, which is decremented in synchronism with a timer interruption signal generated by the timer 6, becomes equal to "0". Instead of modifying the value of the duration data according to the value of tempo data, the decremental value may be modified according to the value of tempo data. Further, instead of modifying the value of duration data according to the value of tempo data, the timer interruption time may be changed according to the value of tempo data.

As a result of the time decoding, one of two kinds of data, i.e. the event data and the performance method code data, is read out, whereby a MIDI event (which means an "event generated by event data i.e. MIDI data in FIG. 7", but will be abbreviated merely as an "event" when there is no fear of confusion) or a performance method code is generated.

When the performance method code is read out, which contains, as described above, a performance method automatically determined (or manually designated), an event or events to which the performance method is to be assigned (hereinafter referred to as "designated event(s)"), various parameters peculiar to the performance method, and the number of beats over which the use of the performance method is to be continued, these data are read out and stored in a buffer provided at a predetermined location of the RAM 5. An event or events which have not yet occurred and correspond to the designated event(s) stored in the buffer (hereafter, data of the designated event(s) stored in the buffer will be also referred to as designated event(s)") so long as there is no fear of confusion) are searched, and a predetermined mark is attached to the event(s) searched out.

When an event occurs, it is determined whether or not the event has the mark attached thereto. If the event has the mark, a designated event-extracting process is carried out to extract the event (i.e. the designated event). When the designated event has been extracted by this process, the tone generator control is not carried out according to the designated event but the performance method interpretation block controls the tone generator such that a musical tone is generated with musical tone variation characteristics, such as tone color variation, pitch variation and amplitude variation, which are dependent on the kind of the performance method, according to the information of the designated event and the performance method stored in the buffer.

On the other hand, when the designated event-extracting process does not extract the designated event, that is, when a normal event other than the designated event occurs, the event is used for normal control of the tone generator. For example, when the event which has occurred is a note-on event, and at the same time it is not the designated event, normal sounding instructions responsive to the note-on event are issued. This generates a normal musical tone as a single musical tone which does not involve special time processing and the like, based. on normal waveform data shown in FIG. 3, which is different from a special performance method waveform.

Figure 9:
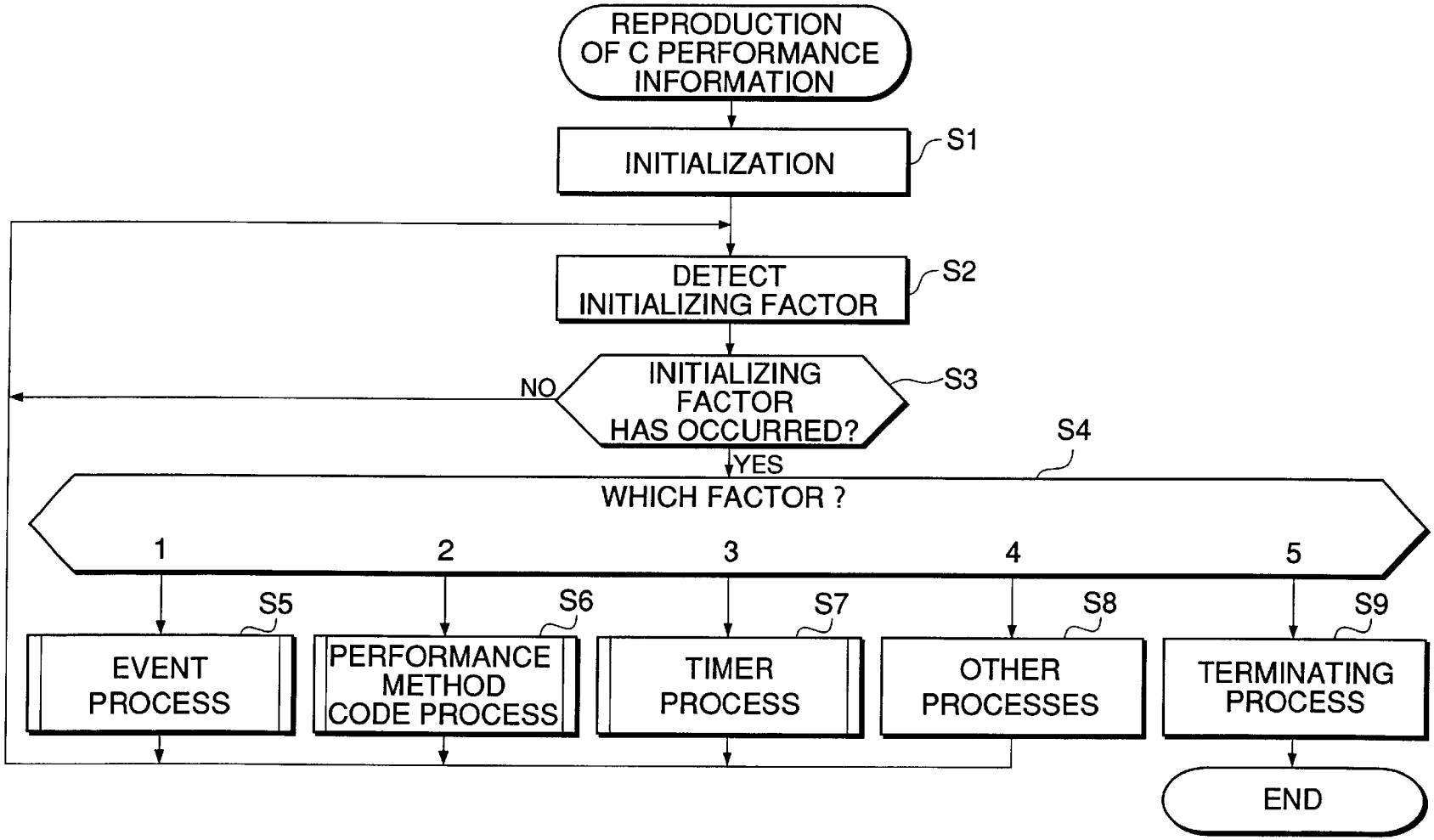
FIG. 9 is a flowchart showing a routine for executing a C performance information-reproducing process for reproducing a C performance information.

FIG. 9 shows a routine for carrying out a process for reproducing C performance information CMF (C performance information-reproducing process), which is started when the player instructs reproduction of the C performance information CMF by using the operating element panel 1 or the like.

Referring to FIG. 9, first, at a step S1, initialization of various devices, parameters, etc. is carried out. This initialization includes a process for reading the C performance information selected by the player from the hard disk to load the same in the C performance information storage area, a process for reading the tone color data TCDk used by the C performance information CMF from the hard disk to load the same in a predetermined area of the waveform RAM 12, and a process for setting the tempo according to temp data stored in the header of the C performance information CMF.

Then, occurrence of initiating factors is checked for at a step S2.

Initiating factor 1: any of the above-mentioned events occurs.

Initiating factor 2: any of the performance method codes occurs.

Initiating factor 3: the timer 6 detects the lapse of a time period set thereto.

Initiating factor 4: any request event other than those constituting the initiating factors 1 to 3, and 5 is detected; for example, an operation event indicating that the user operates the operating element panel 1 is detected.

Initiating factor 5: the power switch, not shown, is turned off.

At the following step S3, it is determined whether or not any of the above initiating factors 1 to 5 has occurred. If none of the initiating factors 1 to 5 has occurred, the program returns to the step S2. If any of the initiating factors 1–5 has occurred, on the other hand, the program proceeds to a step S4 to determine which of the above initiating factors has occurred.

If the result of determination at the step S4 indicates that the "initiating factor 1" has occurred, the program proceeds to a step S5 to execute an event process (details of which will be described hereinafter with reference to FIG. 10) with respect to the generated MIDI event. If the "initiating factor 2" has occurred, the program proceeds to a step S6 to execute a performance method code process (details of which will be described hereinafter with reference to FIG. 11) with respect to the generated performance method code. If the "initiating factor 3" has occurred, the program proceeds to a step S7 to execute a timer process subroutine described hereinafter with reference to FIG. 13. If the "initiating factor 4" has occurred, the program proceeds to a step S8 to execute other processes with respect to the generated request event. If the "initiating factor 5" has occurred, the program proceeds to a step S9 to execute a predetermined terminating process.

After any of the above steps S5–S8 is completed, the program returns to the step S2 to repeat the above-described processing. If the terminating process of the step S9 is completed, the present C performance information-reproducing process is terminated or completed.

Figure 10:
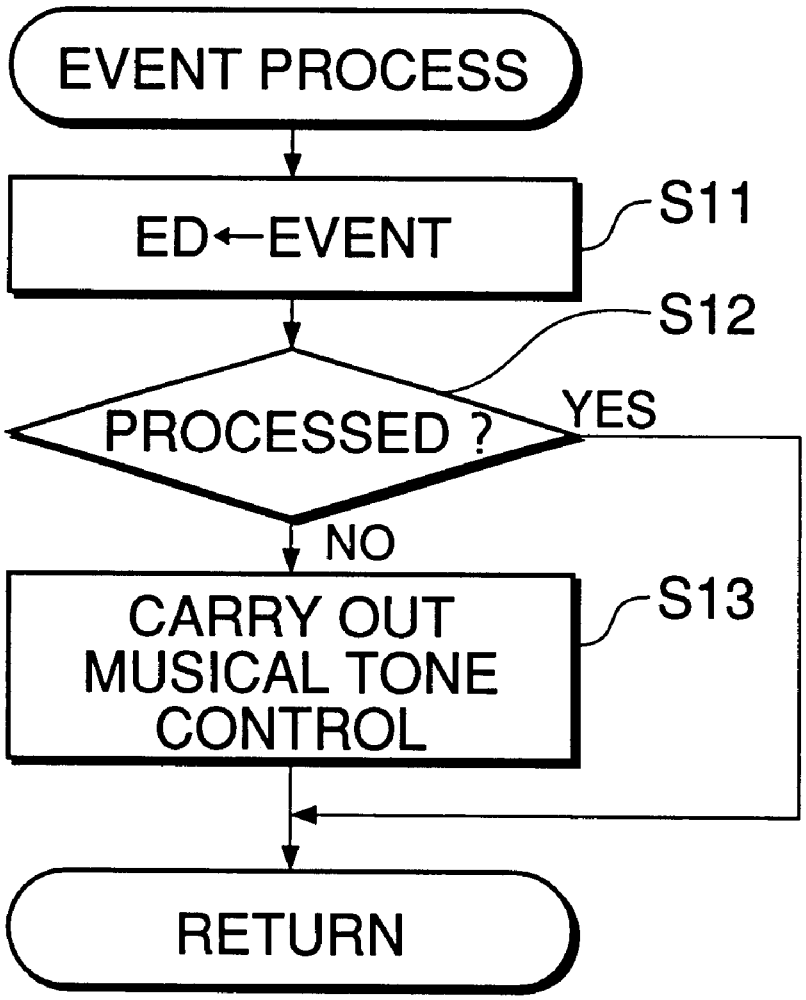
FIG. 10 is a flowchart showing a subroutine executed by the routine of FIG. 9 for an event process.

FIG. 10 shows a subroutine for carrying out the above-mentioned event process.

Referring to FIG. 10, first, at a step S11, the event data constituting the initiating factor 1 is stored in an event data storage area ED provided at a predetermined location of the RAM 5 (hereinafter the contents stored in this area will be referred to as "event data ED").

Then, it is determined at a step S12 whether or not the event data ED is designated as having been processed. The designation of "processed" means that the mark referred to hereinabove with reference to FIG. 8 has been attached to the event, and therefore the event data designated as having been "processed" is data for which a special performance method is designated, i.e. the designated event data.

If it is determined at the step S12 that the data is not designated as having been "processed", the normal musical tone control other than the performance method code process is carried out in response to the event data ED at a step S13. For example, if the event data ED is a "note-on event", generation of one musical tone based on the normal waveform data is instructed to the tone generator (i.e. the access control block 8, the waveform readout block 9, and waveform RAM 12), while if the event data ED is a "note-off event", one musical tone corresponding thereto which is being generated by the tone generator is set to a state of release whereby the sounding of the musical tone is terminated.

On the other hand, if it is determined at the step S12 that the event data ED is designated as having been "processed", the present subroutine for the event process is immediately terminated.

Figure 11:
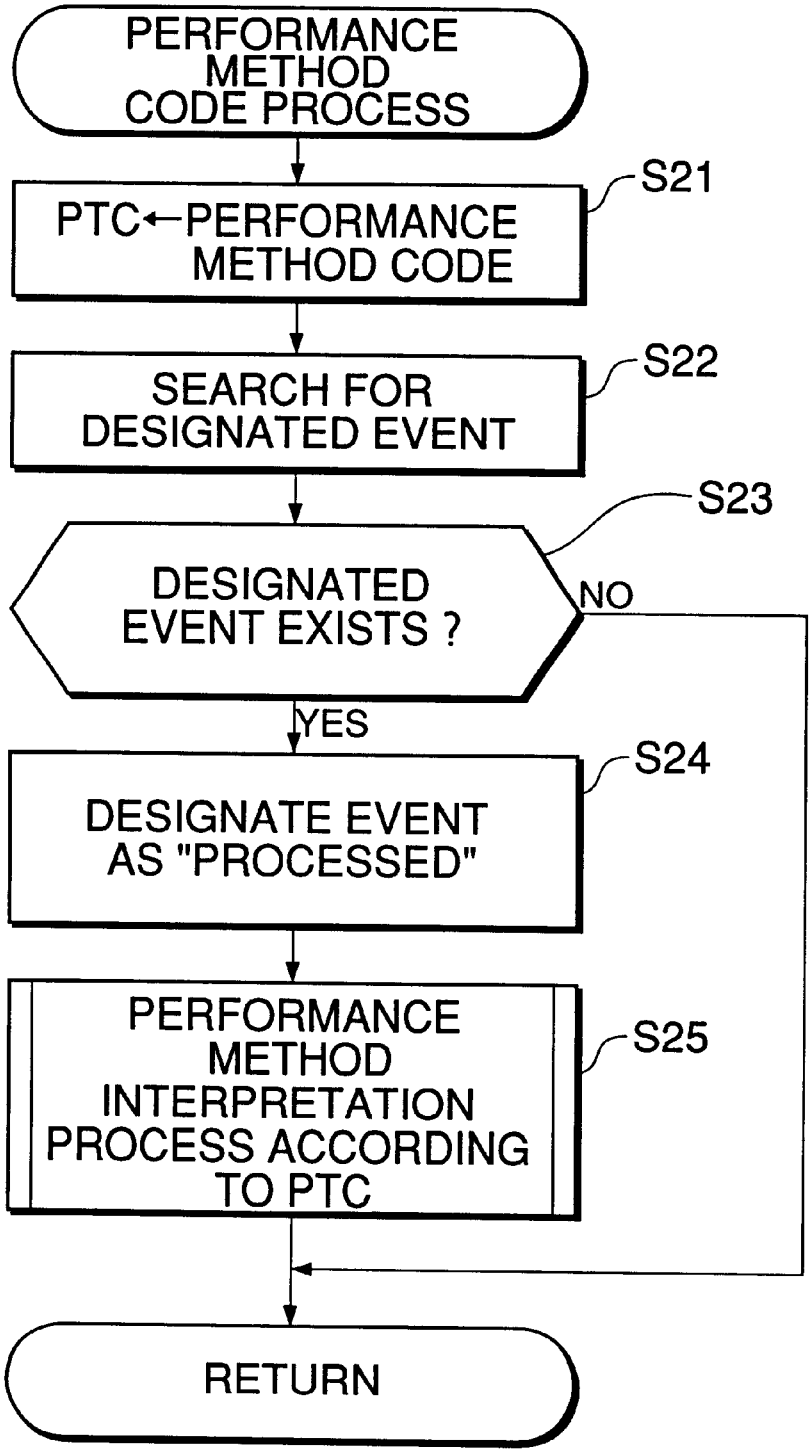
FIG. 11 is a flowchart showing a subroutine executed by the routine of FIG. 9 for a performance method code process.

FIG. 11 shows a subroutine for carrying out the performance method code process executed at the step S6.

First, at a step S21, the performance method code data constituting the initiating factor is stored in a performance method code data storage area PTC provided at a predetermine location of the RAM 5 (hereinafter the contents stored in this area will be referred to as "performance method code data PTC".

Then, event data for which the performance method is designated by the performance method code data PTC is searched for at a step S22. This search is carried out on pieces of event data in the C performance information CMF, which have not yet occurred (not yet been read out), based on the designated event data stored in the buffer.

If the designated event data has been found by this search, the event is designated as having been "processed" at a step S24, and a subroutine for a performance method interpretation process is executed at a step S25. On the other hand, if the designated data has not been found by the search, the present subroutine for the performance method code process is immediately terminated.

The subroutine for the performance method interpretation process is constituted by a plurality of subroutines corresponding respectively to a plurality of performance methods peculiar to each selected tone color, and contained in the performance method interpretation control data 23 in FIG. 3. The designated event(s), i.e. the event data designated by the performance method code can include a plurality of events in the sequence of the C performance information CMF. For example, if the designated performance method is trill, the sequence of notes contains note-on events alternately occurring and having two pitches different from each other by a half note or a full note, as the event data ED, and hence the performance method code of trill designates these plurality of events. Further, this is the same with the case where the designated performance method is glissando. That is, one glissando performance method code designates a sequence of all event data of (or related to) a glissando performance. "To interpret the performance method" means carrying out musical tone control based on the kind of performance method designated by the performance method code instead of musical tone control originally carried out based on the event data. The musical tone control based on the performance method code depends on contents of the event data.

For example, the musical tone control based on the performance method code of trill carries out trill of two pitches in a manner corresponding to note-on's of the two pitches alternately stored in the C performance information. Although in the present embodiment, as the speed parameter, one contained in the performance method code is used, this is not limitative but an average value of time intervals of note-on's of two pitches may be used instead.

Figure 12:
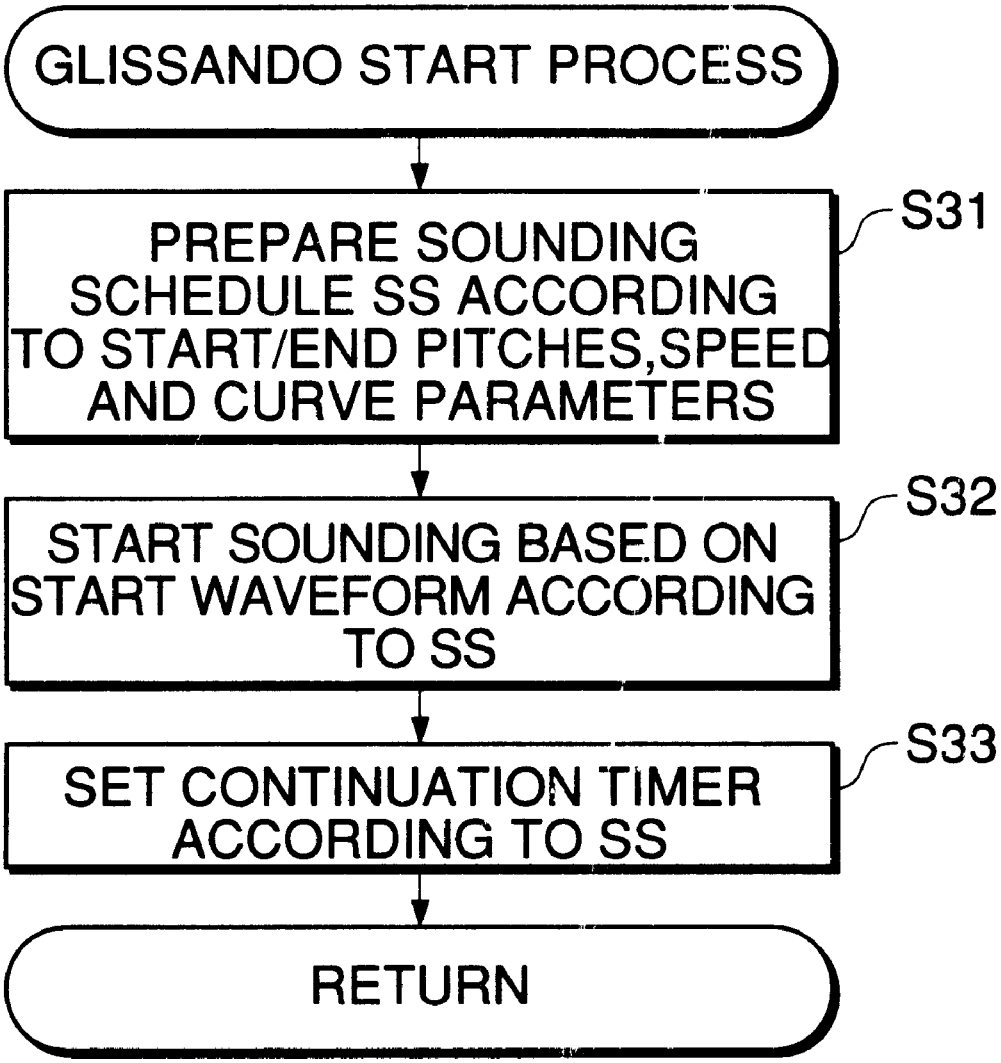
FIG. 12 is a flowchart showing a subroutine for a glissando start process.

FIG. 12 shows a subroutine for carrying out a glissando start process when the tone color of guitar is designated. This process is part of the performance method interpretation process described above, and is called for execution only once at the step S25 in FIG. 11, when the performance method code data PTC designates "glissando".

Referring to FIG. 12, first, at a step S31, a sounding schedule SS is prepared based on the start pitch and end pitch to which the effect of glissando is to be imparted as well as the speed parameter and the curve parameter out of various parameters stored in the buffer. For glissando, events of a sequence of musical tones progressively rising in pitch (or falling in pitch) in the sequence are designated by the performance method code. In the musical tone control based on the performance method code of glissando, the performance method code replaces these events. For example, the start pitch and the end pitch correspond to the first pitch and the last pitch of the sequence of musical tones rising in pitch (or falling in pitch), respectively. Further, the musical tone generated by glissando rises (or falls) according to the scale of a particular key, and therefore the musical tone control is carried out by determining the key of the sequence of musical tones to be generated by the events, and at the same by determining which scale should be used. The sounding schedule is formed by short phrase data containing instructions for sounding of a plurality of notes to actually carry out the performance method designated by the performance method code, and contains data for designating manners of generating musical tones, such as sounding timing suitable for each performance method carried out over the duration of each phrase, pitch variation, waveform variation, volume variation, etc.

Then, the sounding of a start waveform based on the sounding schedule SS is started at a step S32. More specifically, the pitch, waveform data (as the start waveform, normal waveform data is used, instead of the glissando waveform data, as described hereinabove), volume EG, etc., which are indicated by the sounding schedule SS are set to the tone generator, whereby the sounding is started.

Then, timing for instructing sounding of a musical tone following the musical tone of the start pitch of the sequence of musical tones rising in pitch (or falling in pitch) sequentially designated for sounding by the glissando performance, i.e. a time period corresponding to a time interval between the timing of sounding of the musical tone of the start pitch and the timing of sounding of the following musical tone is set to the timer 6, at a step S33, followed by terminating the glissando start process.

Thus, at the tone generator, the attack portion of the start waveform data designated at the step S32 is read out, and then the loop portion of the same waveform data is repeatedly read out, whereby the musical tone generated based on the start waveform continues to be sounded over a time period indicated by the sounding schedule SS, e.g. until the volume of the musical tone is progressively decreased in response to an instruction for starting damping of the musical tone given at a step S41, referred to hereinafter, below a predetermined threshold value (until the musical tone becomes hardly heard).

Figure 13:
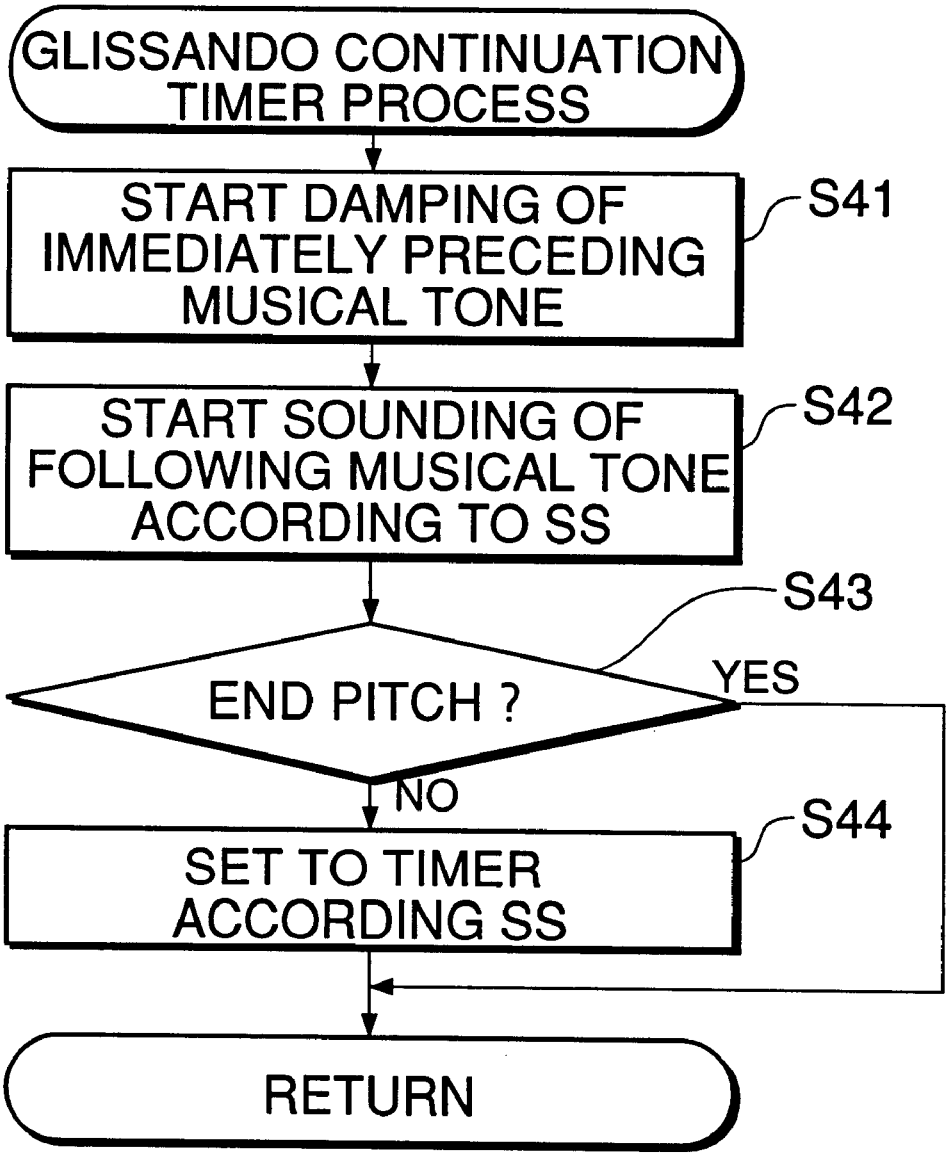
FIG. 13 is a flowchart showing a subroutine for a glissando continuation timer process.

FIG. 13 shows a subroutine for carrying a glissando continuation timer process as part of the timer process subroutine at the step S7, which is executed when the timer 6 detects the lapse of the time period set at the step S33.

Referring to FIG. 13, the damping of a musical tone being generated is started at a step S41.

Then, according to the sounding schedule SS, sounding of the following musical tone is started at a step S42. More specifically, a portion (waveform data) of glissando waveform data (one piece of waveform data formed by the attack portion and the loop portion, described hereinabove with reference to FIG. 4) is designated, which corresponds to the following musical tone indicated by the sounding schedule, i.e. a musical tone following the last musical tone of a sequence of musical tones rising in pitch (or falling in pitch) which are successively designated for sounding by a glissando performance, and similarly to the step S32, the designated waveform data, as well as the pitch designated by the sounding schedule SS, the volume EG, etc. are set to the tone generator, followed by starting the sounding.

Then, it is determined at a step S43 whether or not the pitch of the musical tone being sounded is the end pitch. If the pitch is not the end pitch, i.e. there remains a portion of the glissando waveform to be generated (glissando waveform of each note to be read out), similarly to the step S33, the timer 6 is set according to the sounding schedule SS at a step S44, followed by terminating the glissando continuation timer process.

On the other hand, if it is determined at the step S43 that the musical tone being sounded has the end pitch, the glissando continuation timer process is immediately terminated.

It should be noted that when a performance method of stroke is to be simulated, the simulation can be effected by modifying the above method of simulating the performance method of glissando. More specifically, the sounding schedule SS at the step S31 is modified to one for the performance method of stroke, and the sounding timing pattern is made denser than one for arpeggio, and the damping process at the step S41 is omitted.

Figure 14:
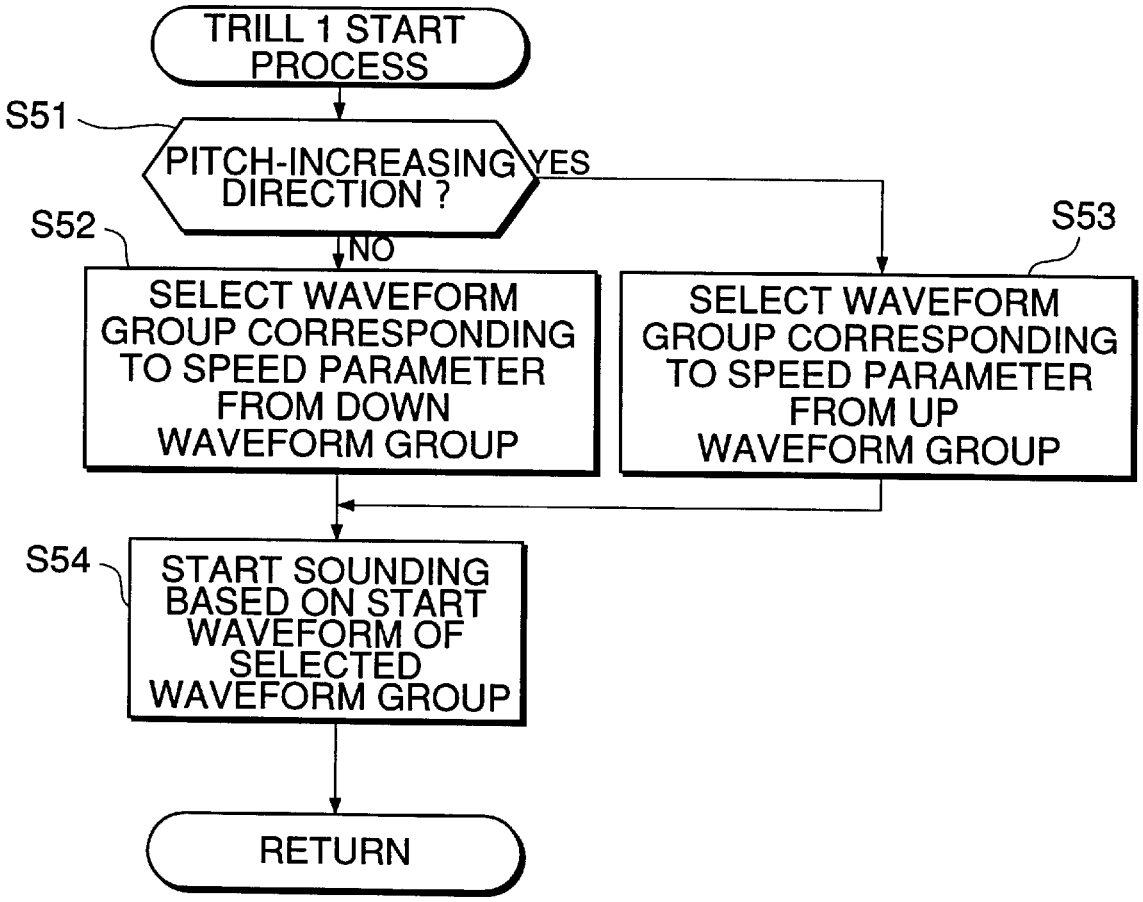
FIG. 14 is a flowchart showing a subroutine for a trill 1 start process.

FIG. 14 shows a subroutine for carrying out a trill 1 start process when the tone color of guitar is designated. This process forms part of the subroutine for the performance method interpretation process at the step S6, and is called for execution only once at the step S25 in FIG. 11 when the performance method code data PTC designates "the trill 1 method".

Referring to FIG. 14, first, at a step S51, it is determined whether or not the player has designated the pitch-increasing direction as the trilling direction. If the player has designated the pitch-decreasing direction, a waveform group corresponding to the speed parameter is selected out of the down waveform group described hereinabove with reference to FIG. 5D, at a step S52. On the other hand, if the player has designated the pitch-increasing direction, a waveform group corresponding to the speed parameter is selected out of the up waveform group described hereinabove with reference to FIG. 5E, at a step S53.

At the following step S54, the sounding of the start waveform of the waveform group selected at the step S52 or S53 is started, and then the trill 1 start process is terminated.

Figure 15:
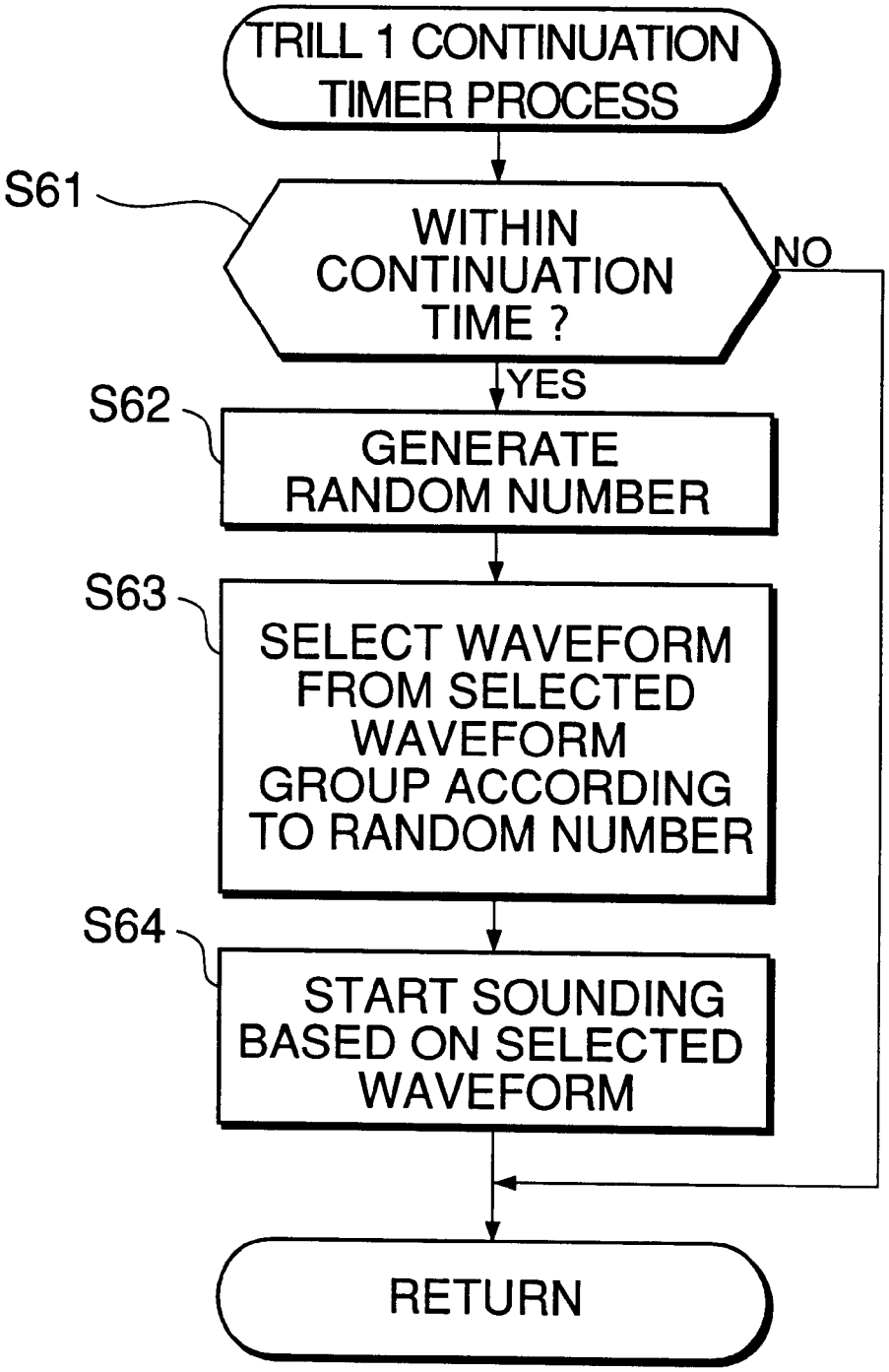
FIG. 15 is a flowchart showing a subroutine for a trill 1 continuation timer process.

FIG. 15 shows a subroutine for carrying out a trill 1 continuation timer process as part of the FIG. 7 subroutine for the timer process. The trill 1 continuation timer process is started when the timer 6 detects the lapse of a predetermined time period, i.e. a time period within which the reading of the start waveform designated for sounding by the trill 1 start process described with reference to FIG. 14 is completed.

Referring to FIG. 15, first, at a step S61, it is determined whether or not a designated continuation time period, i.e. a time period during which the performance based on the trill 1 method is to be continued has elapsed. If the continuation time period within elapsed, the trill 1 continuation timer process is immediately terminated, whereas if the designated continuation time period has not elapsed, the program proceeds to a step S62.

At the step S62, a random number is generated, and at the following step S63, a waveform is selected from the selected waveform group according to the random number. Then, at a step S64, the sounding of a musical tone based on the selected waveform is started, and then the trill 1 continuation timer process is terminated.

Figure 16:
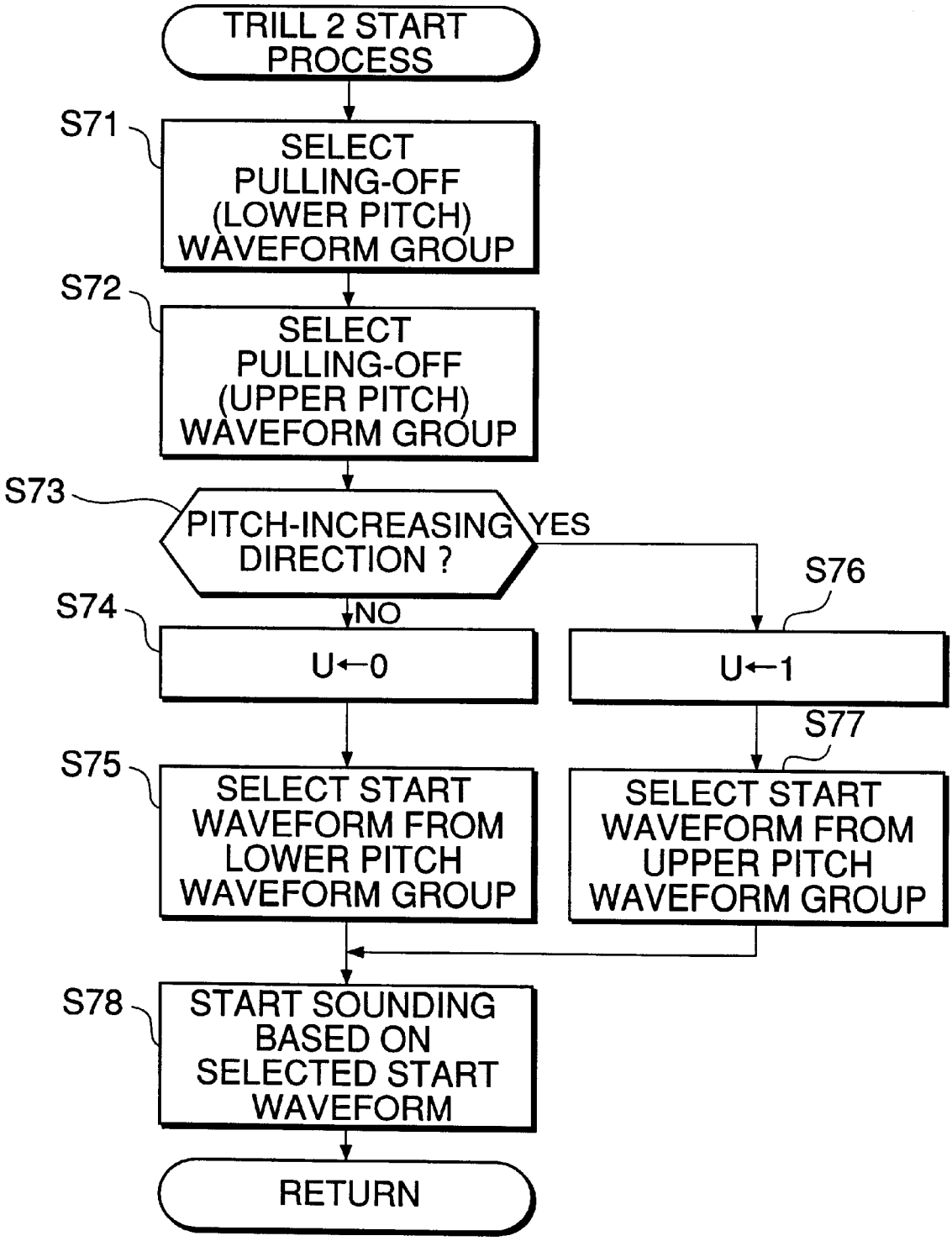
FIG. 16 is a flowchart showing a subroutine for a trill 2 start process.

FIG. 16 shows a subroutine for carrying out a trill 2 start process when the tone color of guitar is selected. This process forms part of the subroutine executed at step S6 for carrying out the performance method interpretation process, and is called for execution only once at the step S25 in FIG. 11 when the performance method code PTC designates "the trill 2 method".

Referring to FIG. 16, first, at a step S71, the pulling-off (lower pitch) waveform group described hereinabove with reference to FIG. 5B is selected, and then at a step S72, the hammering-on (upper pitch) waveform group described hereinabove with reference to FIG. 5C is selected.

Then, it is determined at a step S73 whether or not the player has designated the pitch-increasing direction as the initial trilling direction. On the other hand, if the player has designated the pitch-decreasing direction as the initial trilling direction, a trilling direction flag U, which, when set to "1", indicates that the trilling direction is the pitch-increasing direction, is set to "0" (which indicates that the pitch-decreasing direction has been designated) at a step S73, and a start waveform is selected from the lower pitch waveform group, at a step S75.

On the other hand, if it is determined at the step S73 that the player has designated the pitch-increasing direction as the initial trilling direction, the trilling direction flag U is set to "1" (which indicates that the pitch-increasing direction has been designated) at a step S76, and a start waveform is selected from the upper pitch waveform group at a step S77.

At the following step S78, the sounding of a musical tone based on the start waveform selected at the step S75 or S77 is started, followed by terminating the trill 2 start process.

Figure 17:
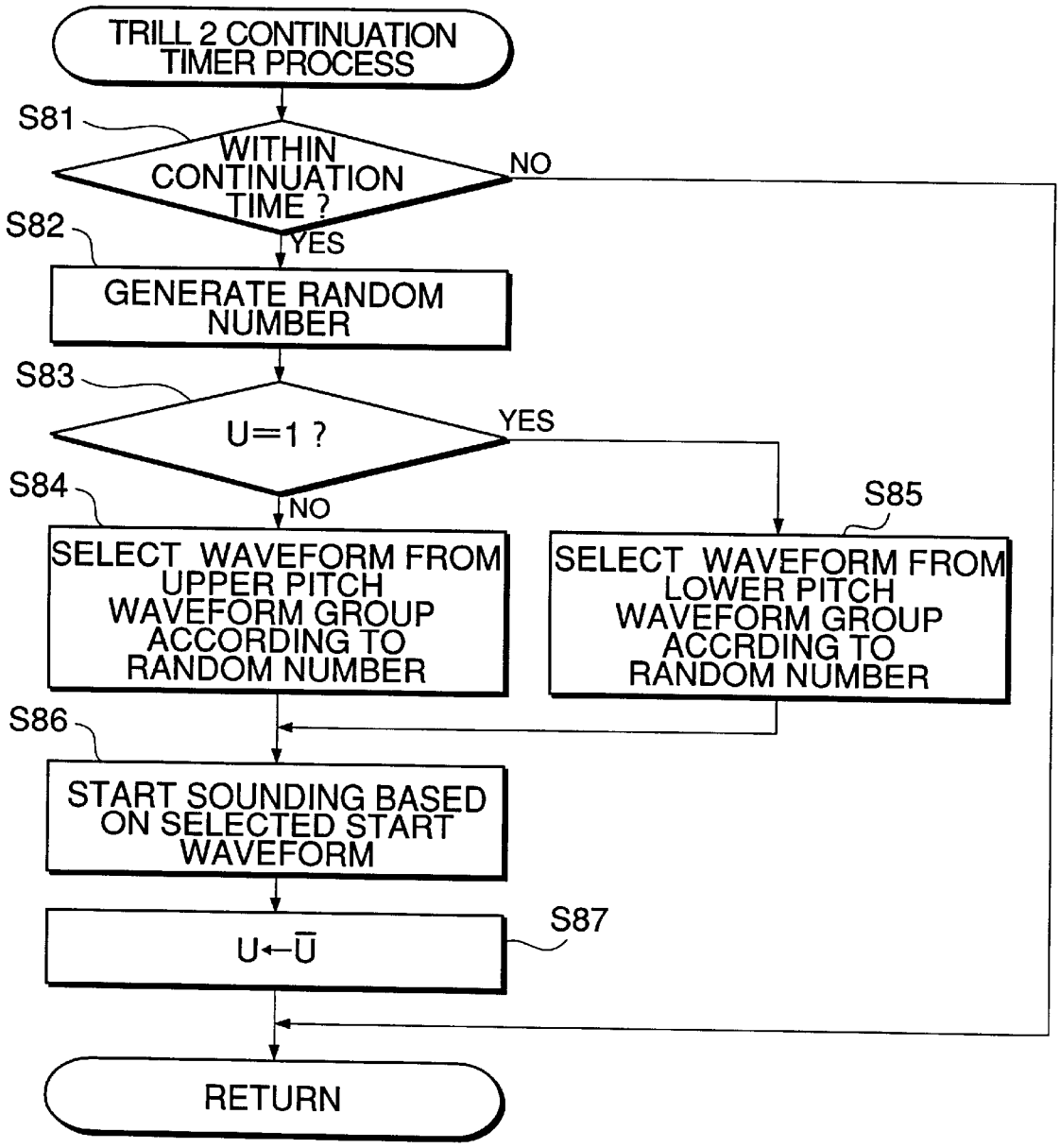
FIG. 17 is a flowchart showing a subroutine for a trill 2 continuation timer process.

FIG. 17 shows a subroutine for carrying out the trill 2 continuation time process which forms part of the subroutine executed at the step S7 for carrying out the timer process. The trill 2 continuation timer process is started when the timer 6 detects the lapse of a predetermined time period, i.e. a time period within which the reading of the start waveform designated by the trill 2 start process described above with reference to FIG. 14 is completed.

Referring to FIG. 17, first, at a step S81, it is determined whether or not a designated continuation time period, i.e. a time period during which a trill 2 performance is to be continued has elapsed. If the continuation time period has elapsed, the trill 2 continuation timer process is terminated, whereas if the designated continuation time period has elapsed, the program proceeds to a step S82, wherein a random number is generated.

At the following step S83, it is determined whether or not the trilling direction flag U assumes "1". If U=0 holds, i.e. if the trilling direction is the pitch-decreasing direction, a waveform is selected from the hammering-on (upper pitch) waveform group according to the generated random number referred to hereinabove at a step S84. On the other hand, if U=1 holds, i.e. if the trilling direction is the pitch-increasing direction, a waveform is selected from the pulling-off (lower pitch) waveform group according to the generated random number at a step S85.

Then, the sounding of a musical tone based on the waveform selected at the step S84 or S85 is started at a step S86, and then the trilling direction flag U is inverted, followed by terminating the trill 2 continuation timer process.

As described above, according to the present embodiment, musical tones generated by specific performance methods peculiar to natural instruments are sampled, and the sampled musical tone data are processed and stored in a memory device, such as a hard disk, and the performance methods peculiar to the natural instruments are simulated based on the musical tone data thus stored. Therefore, it is possible to faithfully reproduce variations in tone color caused by various performance methods peculiar to each natural instrument.

Although in the present embodiment, waveform data based on various performance methods, such as glissando waveform data and tremolo waveform data, are prepared for each note, this is not limitative, but since a normal waveform memory tone generator can easily effect a pitch shift by using an F number or the like, only one waveform data may be prepared for each sequence of a plurality of notes and subjected to pitch shift according to each note. This can reduce the capacity of the waveform memory.

Further, although in the present embodiment, waveforms based on pulling-off and hammering-on performance methods are recorded or sampled as trill raw waveform data, this is not limitative, but there may be also employed trill performance waveforms generated by sliding fingers at frets, or a pitch bend performance method.

It should be noted that according to the present embodiment, the designation of a performance method and the reproduction of performance information are separately carried out, this is not limitative, but real time performance or automatic performance reproduction may be carried out by designating a performance method in real time using a manual performance method-designating switch.

Further, although in the present embodiment, a waveform memory tone generator is employed as the tone generator, this is not limitative, but the present invention can be applied to other types of tone generators. In such a case, instead of providing a plurality of waveforms corresponding to a plurality of performance methods, only kinds of waveforms corresponding to performance methods to which tone color parameters can be set may be provided, whereby similarly to the present embodiment, the sounding of musical tones may be controlled by a sounding control program suitable for each performance method. The object of the present invention may be accomplished by providing a storage medium in which a software program having the functions of the above-described embodiment is recorded, in a system or apparatus, and causing a computer (CPU 3 or MPU) of the system or apparatus to read out and execute the program stored in the storage medium.

In this case, the program itself read out from the storage medium achieves the novel functions of the present invention, and the storage medium storing the program constitutes or provides the present invention.

The storage medium for supplying the program to the system or apparatus may be in the form of the hard disc as described above, CD-ROM, MO, MD, floppy disc, CD-R (CD-Recordable), magnetic tape, nonvolatile memory card, or ROM 4, for example. Also, the program may be supplied from other MIDI equipment or a server computer through a communication network.

The functions of the illustrated embodiment may be accomplished not only by executing the program read out by the computer, but also by causing an OS operating on the computer to perform a part of or all of actual operations according to the instructions of the program.

Further, the program read out from the storage medium may be written in a memory provided in an expanded function board inserted in the computer, or an expanded function unit connected to the computer, and the CPU 3 or the like provided in the expanded function board or expanded function unit may actually perform a part of or all of the operations, based on the instructions of the program, so as to accomplish the functions of the illustrated embodiment.

What is claimed is:

1. A method of generating a musical tone, comprising:

a decomposing step of decomposing musical performance data into a plurality of pieces;

an analyzing step of analyzing at least one piece of said plurality of pieces obtained by said decomposing step;

a preparing step of preparing tone color control data for each of said plurality of pieces according to results of said analyzing;

a reproducing step of reproducing said plurality of pieces at timings at which said plurality of pieces are to be performed; and a controlling step of controlling tone color characteristics of a musical tone to be generated based on said plurality of pieces which are reproduced by said reproducing step, according to said tone color control data prepared for said each of said plurality of pieces.

2. A method of generating musical tones, comprising:

a first providing step of providing a plurality of pieces of performance control information corresponding to respective performance methods;

a first receiving step of receiving performance data representing at least one musical note;

a second receiving step of receiving performance method data;

a selecting step of selecting one of said pieces of performance control information which corresponds to said performance method data received by said second receiving step;

a musical tone-generating step of generating a musical tone based on said performance data; and a controlling step of controlling tone color characteristics of said musical tone generated by said musical tone-generating step, according to said selected one of said pieces of performance control information.

3. A method according to claim 2, including:

a tone color-selecting step of selecting a kind of tone color of a musical tone to be generated;

a second providing step of providing pieces of said performance method data peculiar to said selected kind of tone color; and a second selecting step of selecting a desired piece of performance data from said pieces of said performance method data peculiar to said kind of tone color selected by said tone color-selecting step, according to said performance data;

said second receiving step receiving said desired piece of performance method data selected by said second selecting step.

4. A method according to claim 2, wherein said pieces of performance control information each include a plurality of waveform data corresponding respectively to said performance methods.

5. A method according to claim 2, wherein said pieces of performance control information each include a plurality of sounding control programs corresponding respectively to said performance methods.

6. A method of generating musical tones, comprising:

a first storing step of storing a plurality of kinds of waveforms for generating one of glissando and slur waveforms in musical tone waveform-storing means, each of said kinds of waveforms itself having a tone color variation characteristic and a pitch variation characteristic peculiar to a corresponding one of glissando and slur performance methods, and comprising an attack portion to be read out first only once and a loop portion to be repeatedly read out after said attack portion is read out;

a waveform-designating step of sequentially designating a sequence of waveforms necessary for generating a desired one of glissando and slur waveforms from said plurality of kinds of waveforms stored in said musical tone waveform-storing means;

a timing-designating step of designating sounding timing for starting reading of each waveform of said sequence of waveforms designated by said waveform-designating step;

a first reading step of starting reading of said attack portion of said each waveform of said designated sequence of waveforms, at said designated sounding timing while terminating reading of an immediately preceding waveform being sounded;

a second reading step of repeatedly reading said loop portion following said attack portion upon completion of said reading of said attack portion; and a generating step of generating musical tones based on said waveforms read out by said first reading step or said second reading step.

7. A method of generating a musical tone, comprising the steps of:

storing plural kinds of waveforms for a musical tone with each of said plural kinds of waveforms changing in pitch between two predetermined pitches;

reading out one from among said plural kinds of waveforms;

repeating said steps of reading out during a period in a manner of selecting a kind of waveform to be read out from among the plural kinds of waveforms whenever the step of reading out is executed; and generating a musical tone based on the waveforms read out by said step of repeating.

8. The method of claim 7, wherein said reading step further comprises the step of reading out at random one from among said plural kinds of waveforms.

9. A method according to claim 7, wherein said plural kinds of waveforms changing in pitch are waveforms corresponding to a trill method.

10. A method of generating musical tones, comprising:

a first storing step of storing a plurality of kinds of waveforms of musical tones each having a first pitch characteristic as a first musical tone waveform group in first waveform-storing means;

a second storing step of storing a plurality of kinds of waveforms of musical tones each having a second pitch characteristic as a second musical tone waveform group in second waveform-storing means;

a selecting step of selecting alternately said first musical tone waveform group and said second musical tone waveform group;

a reading step of reading at random waveforms from the selected musical tone waveform group; and a generating step of generating a musical tone based on the waveforms read out by said reading step.

11. A storage medium that stores a program that can be carried out by a computer, the program comprising:

a decomposing module that decomposes musical performance data into a plurality of pieces;

an analyzing module that analyzes at least one piece of said plurality of pieces obtained by execution of said decomposing module;

a preparing module that prepares tone color control data for each of said plurality of pieces according to results of said analyzing;

a reproducing module that reproduces said plurality of pieces at timing at which said plurality of pieces are to be performed; and a controlling module that controls tone color characteristics of a musical tone to be generated based on said plurality of pieces which are reproduced by execution of said reproducing module, according to said tone color control data prepared for said each of said plurality of pieces.

12. A storage medium that stores a program that can be carried out by a computer, the program comprising:

a providing module that provides a plurality of pieces of performance control information corresponding to respective performance methods;

a first receiving module that receives performance data representing at least one musical note;

a second receiving module that receives performance method data;

a selecting module that selects one of said pieces of performance control information which corresponds to said performance method data received by execution of said second receiving module;

a musical tone-generating module that generates a musical tone based on said performance data; and a controlling module that controls tone color characteristics of said musical tone generated by execution of said musical tone-generating module, according to said selected one of said pieces of performance control information.

13. A storage medium that stores a program that can be carried out by a computer, the program comprising:

a first storing module that stores a plurality of kinds of waveforms for generating one of glissando and slur waveforms in musical tone waveform-storing means, each of said kinds of waveforms itself having a tone color variation characteristic and a pitch variation characteristic peculiar to a corresponding one of glissando and slur performance methods, and comprising an attack portion to be read out first only once and a loop portion to be repeatedly read out after said attack portion is read out;

a waveform-designating module that sequentially designates a sequence of waveforms necessary for generating a desired one of glissando and slur waveforms from said plurality of kinds of waveforms stored in said musical tone waveform-storing means;

a timing-designating module that designates sounding timing for starting reading of each waveform of said sequence of waveforms designated by execution of said waveform-designating module;

a first reading module that starts reading of said attack portion of said each waveform of said designated sequence of waveforms, at said designated sounding timing while terminating reading of an immediately preceding waveform being sounded;

a second reading module that repeatedly reads said loop portion following said attack portion upon completion of said reading of said attack portion; and a generating module that generates musical tones based on said waveforms read out be execution of said first reading module or said second reading module.

14. A storage medium that stores a program that can be carried out by a computer, the program comprising:

a storing module that stores plural kinds of waveforms for a musical tone with each of said plural kinds of waveforms changing in pitch between two predetermined pitches;

a reading module that reads out one from among said plural kinds of waveforms;

a repeating module that repeats executions of said reading module during a period in a manner of selecting a kind of waveform to be read out from among the plural kinds of waveforms whenever the module of reading out is executed; and a generating module that generates a musical tone based on the waveforms read out by execution of said repeating module.

15. The storage medium of claim 14, wherein said reading module further reads out at random one from among said plural kinds of waveforms.

16. A storage medium according to claim 14, wherein said plural kinds of waveforms changing in pitch are waveforms corresponding to a trill method.

17. A storage medium that stores a program that can be carried out by a computer, the program comprising:

a first storing module that stores a plurality of kinds of waveforms of musical tones each having a first pitch characteristic as a first musical tone waveform group in first waveform-storing means;

a second storing module that stores a plurality of kinds of waveforms of musical tones each having a second pitch characteristic as a second musical tone waveform group in second waveform-storing means;

a selecting module that selects alternately said first musical tone waveform group and said second musical tone waveform group;

a reading module that reads out at random waveforms from the selected musical tone waveform group; and a generating module that generates a musical tone based on the waveforms read out by execution of said reading module.

18. A method of processing musical performance data, comprising the steps of:

analyzing a progression manner of at least one note in musical performance data;

decomposing said musical performance data into a plurality of pieces according to results of said analyzing; and determining a performance method for each of said plurality of pieces, which is to be applied in performing said each of said plurality of pieces.

19. A method according to claim 18, further including the step of reproducing said musical performance data based on said determined performance method.

20. A method according to claim 18, wherein a sequence of notes in performance information of said musical performance data are analyzed, said sequence of notes being decomposed into said plurality of pieces, each of which is to be performed by a same performance method, based on results of said analyzing, and said performance method for said each of said plurality of pieces being determined based on a characteristic of said each of said plurality of pieces.

21. A method according to claim 16, wherein said characteristic is a pitch characteristic.

22. A method according to claim 18, wherein said plurality of pieces of said musical performance data and performance methods to be applied in performing respective ones of said plurality of pieces are determined, said musical performance data being decomposed into said plurality of pieces each of which is to be performed by a same performance method based on results of said determination, with the performance method being designated for each of the plurality of pieces decomposed.

23. A method according to claim 22, wherein said determination and said designation are made by a user.

24. A method of processing musical performance data, comprising the steps of:

selecting tone color data for musical performance data;

analyzing at least one piece of said musical performance data in a manner corresponding to the selected tone color data; and forming musical tone data by attaching performance method data indicative of a performance method corresponding to a result of said analyzing to said musical performance data.

25. A method of forming musical tone data, comprising the steps of:

storing at least two pieces of performance method data respectively indicative of different performance methods with respect to each of at least two different tone colors;

selecting a tone color from among said at least two different tone colors;

selecting one of said two pieces of performance method data corresponding to the selected tone color; and forming musical tone data based on the selected performance method data and the selected tone color.

26. A method of generating musical tone waveform data, comprising the steps of:

receiving performance information;

receiving performance method designating data;

selecting one tone color from a plurality of tone colors for said performance information;

storing at least two pieces of performance method control data corresponding to at least two performance methods for each of said plurality of tone colors;

selecting at least one piece of performance method control data corresponding to the selected one tone color from the stored at least two pieces of performance method control data, according to the received performance method designating data; and forming musical tone waveform data based upon the received performance information and the selected at least one piece of performance method control data.

27. A method of generating musical tone waveform data, comprising the steps of:

storing a plurality of pieces of tone color data each including first control data and second control data respectively for designating a first performance method and a second performance method, third control data for controlling a tone generation manner corresponding to said first performance method, and fourth control data for designating waveform data corresponding to said first performance method;

selecting one piece of tone color data from the stored plurality of pieces of tone color data;

selecting said first control data from among said first control data and said second control data; and generating a musical tone based on said waveform data in said tone generation manner, said waveform data and said tone generation manner corresponding to the selected tone color data and said first control data.

28. A method of forming musical tone data, comprising the steps of:

storing a plurality of pieces of tone color data each including control data for designating at least one performance method corresponding to performance information of musical performance data;

selecting one piece of tone color data from the stored plurality of pieces of tone color data for said musical performance data; and forming musical tone data by designating at least one performance method based on said musical performance data and the selected one piece of tone color data and attaching performance method designating data indicative of the designated at least one performance method to said musical performance data.

29. A method of forming musical tone waveform data, comprising the steps of:

receiving performance information;

receiving performance method designating data for designating at least one performance method corresponding to said performance information;

storing a plurality of pieces of tone color data each including first control data for controlling a manner of generating musical tunes according to the at least one performance method designated by said performance method designating data, and second control data for designating at least one waveform corresponding to the designated at least one performance method;

selecting one piece of tone color data fruit from the stored plurality of pieces of tone color data for said performance information; and forming musical tone waveform data having at least one waveform designated by said second control data of the selected one piece of tone color data and corresponding to said performance information, in a manner based on said first control data of the selected one piece of tone color data.

30. A method of forming musical tone data, comprising the steps of:

storing at least two pieces of performance method data respectively indicative of different performance methods with respect to each of at least two different tone colors for musical performance data;

designating a tone color from among at least two different tone colors;

designating one of two pieces of performance method data corresponding to the designated tone color; and forming musical tone data by attaching the designated performance method data to musical performance data.

31. A method of forming musical tone waveform data, comprising the steps of:

providing musical tone data comprising musical piece data having event data and timing data indicative of timing of generating said event data, and a performance method code indicative of a performance method and a portion of said event data to be performed by said performance method;

generating an event indicative of said event data of said musical piece data at timing indicated by said timing data of said musical piece data, while designating said performance method indicated by said performance method code for said portion of said event data to be performed by said performance method; and forming musical tone data corresponding to the generated event and the designated performance method.

32. A method of forming musical tone data, comprising the steps of:

receiving musical performance data;

storing at least two pieces of performance method data respectively indicative of different performance methods with respect to each of at least two different tone colors for musical performance data:

designating a tone color from among at least two different tone colors;

designating one of two pieces of performance method data corresponding to the designated tone color;

generating a musical tone based on said musical performance data; and controlling tone color characteristics of the generated musical tone, according to the designated tone color and the designated performance method data.

33. A musical tone generating apparatus for processing musical performance data, said musical performance data obtained by:

analyzing a progression manner of at least one note in said musical performance data;

decomposing said musical performance data into a plurality of pieces according to results of said analyzing; and determining a performance method for each of said plurality of pieces, which is to be applied in performing each of said plurality of pieces.

34. A medium which stores data prepared using the steps of:

analyzing a progression manner of at least one note in musical performance data;

decomposing said musical performance data into a plurality of pieces according to results of said analyzing;

determining a performance method for each of said plurality of pieces, which is to be applied in performing each of said plurality of pieces; and storing data representative of said determined performance method for each of said plurality of pieces in a medium.

35. A musical tone generating apparatus for processing musical performance data, said musical performance data obtained by:

selecting tone color data for said musical performance data;

analyzing at least one piece of said musical performance data in a manner corresponding to the selected tone color data; and forming musical tone data by attaching performance method data indicative of a performance method corresponding to a result of said analyzing to said musical performance data.

36. A medium which stores data prepared using the steps of:

selecting tone color data for musical performance data;

analyzing at least one piece of said musical performance data in a manner corresponding to the selected tone color data;

forming musical tone data by attaching performance method data indicative of a performance method corresponding to a result of said analyzing to said musical performance data; and storing data representative of said formed musical tone data in a medium.

37. A musical tone generating apparatus for processing musical performance data, said musical performance data obtained by:

reproducing said musical performance data;

generating performance method data indicative of a performance method during the reproduction of said musical performance data; and forming musical tone waveform data based on said musical performance data and said performance method data.

38. A medium which stores data prepared using the steps of:

reproducing musical performance data;

generating performance method data indicative of a performance method during the reproduction of said musical performance data;

forming musical tone waveform data based on said musical performance data and said performance method data;

providing a storage medium; and storing data representative of said formed musical tone waveform data in the storage medium.

39. A method of forming musical tone data, comprising the steps of:

storing at least three kinds of waveform data corresponding respectively to different performance methods;

selecting one of said different performance methods;

reading out waveform data corresponding to the selected performance method; and forming musical tone data based on said waveform data read out by said step of reading out.

* * * * *